US011177569B2

(12) United States Patent
Ndip et al.

(10) Patent No.: US 11,177,569 B2
(45) Date of Patent: Nov. 16, 2021

(54) THREE-DIMENSIONAL LOOP ANTENNA DEVICE

(71) Applicant: Fraunhofer-Gesellschaft zur Foerderung der angewandten Forschung e.V., Munich (DE)

(72) Inventors: Ivan Ndip, Berlin (DE); Christine Kallmayer, Berlin (DE); Klaus-Dieter Lang, Berlin (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 19 days.

(21) Appl. No.: 16/676,098

(22) Filed: Nov. 6, 2019

(65) Prior Publication Data

US 2020/0144721 A1 May 7, 2020

(30) Foreign Application Priority Data

Nov. 6, 2018 (DE) ..... 10 2018 218 891.2

(51) Int. Cl.
*H01Q 7/00* (2006.01)
*H01Q 1/22* (2006.01)

(52) U.S. Cl.
CPC ..... *H01Q 7/00* (2013.01); *H01Q 1/22* (2013.01)

(58) Field of Classification Search
CPC ..... H01Q 7/00; H01Q 1/22; H01Q 1/2283
USPC ..... 343/866
See application file for complete search history.

(56) References Cited

U.S. PATENT DOCUMENTS

| | | | | |
|---|---|---|---|---|
| 4,816,836 | A | 3/1989 | Lalezari | |
| 5,173,715 | A | 12/1992 | Rodal et al. | |
| 5,521,610 | A | 5/1996 | Rodal | |
| 5,784,032 | A * | 7/1998 | Johnston | H01Q 1/243 343/702 |
| 5,977,710 | A | 11/1999 | Kuramoto et al. | |
| 6,590,541 | B1 | 7/2003 | Schultze | |
| 6,795,023 | B2 | 9/2004 | Chen | |
| 8,138,987 | B2 * | 3/2012 | Kapuliansky | H01Q 1/38 343/866 |
| 8,791,868 | B2 | 7/2014 | Mccarthy et al. | |
| 8,922,446 | B2 | 12/2014 | Alexopoulos et al. | |
| 2004/0070536 | A1 | 4/2004 | Stotler et al. | |
| 2008/0074271 | A1 * | 3/2008 | Hodges | G06K 19/07796 340/572.7 |

(Continued)

FOREIGN PATENT DOCUMENTS

| | | | |
|---|---|---|---|
| DE | 102012016627 | A1 | 2/2014 |
| DE | 102017200130 | A1 | 7/2018 |

(Continued)

*Primary Examiner* — Jean B Jeanglaude
(74) *Attorney, Agent, or Firm* — Perkins Coie LLP; Michael A. Glenn

(57) ABSTRACT

An antenna device includes a substrate extending within a substrate plane, the substrate having a first side and an oppositely arranged second side, and a three-dimensional shape structure which is arranged on the first side and protrudes from the substrate plane, and a strip structure arranged at the three-dimensional shape structure, and a rear-side metallization which is arranged on the second side of the substrate and is electrically coupled to the strip structure so that the strip structure and the rear-side metallization form a loop antenna.

24 Claims, 20 Drawing Sheets

(56) References Cited

U.S. PATENT DOCUMENTS

| | | | | |
|---|---|---|---|---|
| 2011/0043408 | A1 | 2/2011 | Shi et al. | |
| 2013/0050031 | A1* | 2/2013 | Zhu | H01Q 1/523 343/702 |
| 2013/0113669 | A1 | 5/2013 | Bellows | |
| 2014/0118211 | A1 | 5/2014 | Cooper et al. | |
| 2014/0320378 | A1 | 10/2014 | Gracias et al. | |
| 2015/0162660 | A1 | 6/2015 | Orsi et al. | |
| 2016/0218433 | A1* | 7/2016 | Nghiem | H01Q 1/38 |
| 2016/0248149 | A1 | 8/2016 | Kim et al. | |
| 2018/0191054 | A1 | 7/2018 | Ndip | |

FOREIGN PATENT DOCUMENTS

| | | | |
|---|---|---|---|
| WO | 2009102714 | A2 | 8/2009 |
| WO | 2010123733 | A1 | 10/2010 |
| WO | 2012165797 | A2 | 12/2012 |

* cited by examiner

THREE-DIMENSIONAL LOOP ANTENNA DEVICE

CROSS-REFERENCE TO RELATED APPLICATION

This application claims priority from German Patent Application No. DE 10 2018 218 891.2, which was filed on Nov. 6, 2018, and is incorporated herein in its entirety by reference.

The present invention relates to antenna devices, and in particular to three-dimensional loop antenna devices.

BACKGROUND OF THE INVENTION

At relatively high frequencies, e.g., within the millimeter wavelength range and higher, radiation efficiency of antennas integrated in a planar manner suffers greatly from losses in connection with dielectrics used in the manufacturing of antennas. These include dielectric losses and surface-wave losses. 3D antennas not directly resting on a substrate, exhibit higher efficiency. However, at low frequencies (e.g., within the lower GHz range), the lengths of such antennas are very long. With such lengths, some structures are instable.

It would therefore be desirable to provide an antenna device for high frequencies which exhibits high stability despite small dimensions while being highly efficient.

SUMMARY

According to an embodiment, an antenna device may have: a substrate extending within a substrate plane, the substrate having a first side and an oppositely arranged second side, and a three-dimensional shape structure which is arranged on the first side and protrudes from the substrate plane, and a strip structure arranged at the three-dimensional shape structure, and a rear-side metallization which is arranged on the second side of the substrate and is electrically coupled to the strip structure so that the strip structure and the rear-side metallization form a loop antenna.

According to another embodiment, an antenna array may have: a first inventive antenna device and a second inventive antenna device.

According to another embodiment, an electric device may have: a multi-layered circuit structure, which has at least one high-frequency chip, and an antenna arrangement which includes an inventive antenna device and/or an inventive antenna array, wherein the antenna arrangement is arranged at the multi-layered circuit structure and is electrically connected to the high-frequency chip, and wherein the antenna arrangement is configured to emit a high-frequency signal of the high-frequency chip and/or to receive a high-frequency signal and to provide same to the high-frequency chip.

The inventive antenna device comprises a substrate extending within a substrate plane. The substrate comprises a first side and an oppositely arranged second side. The first side has a three-dimensional shape structure arranged thereon which protrudes from the substrate plane. The three-dimensional shape structure has a strip structure arranged thereon which, along with a rear-side metallization arranged on the second side of the substrate, provides a loop antenna since the rear-side metallization is electrically coupled to the strip structure. The three-dimensional shape structure acts as a kind of support structure for the strip structure. This means that the strip structure does not have to support itself but may be arranged directly on the stable three-dimensional shape structure. As a result, the inventive antenna device exhibits a stability that is clearly higher than that of conventional three-dimensional antennas. In addition, due to the three-dimensional shape structure, the strip structure is spaced apart from the substrate. Due to the inventive configuration of the antenna structure, a radiation characteristic may be obtained that is comparable to that of ribbon bond antennas and/or bond wire antennas, which is advantageous. At the same time, comparatively higher radiation efficiency may be obtained on the basis of a flexibly adjustable expansion of the strip structure. Alternatively or additionally, a large number of different configurations are also possible since the three-dimensional shape structure enables a high degree of rigidity of the arrangement, which enables high mechanical stability.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
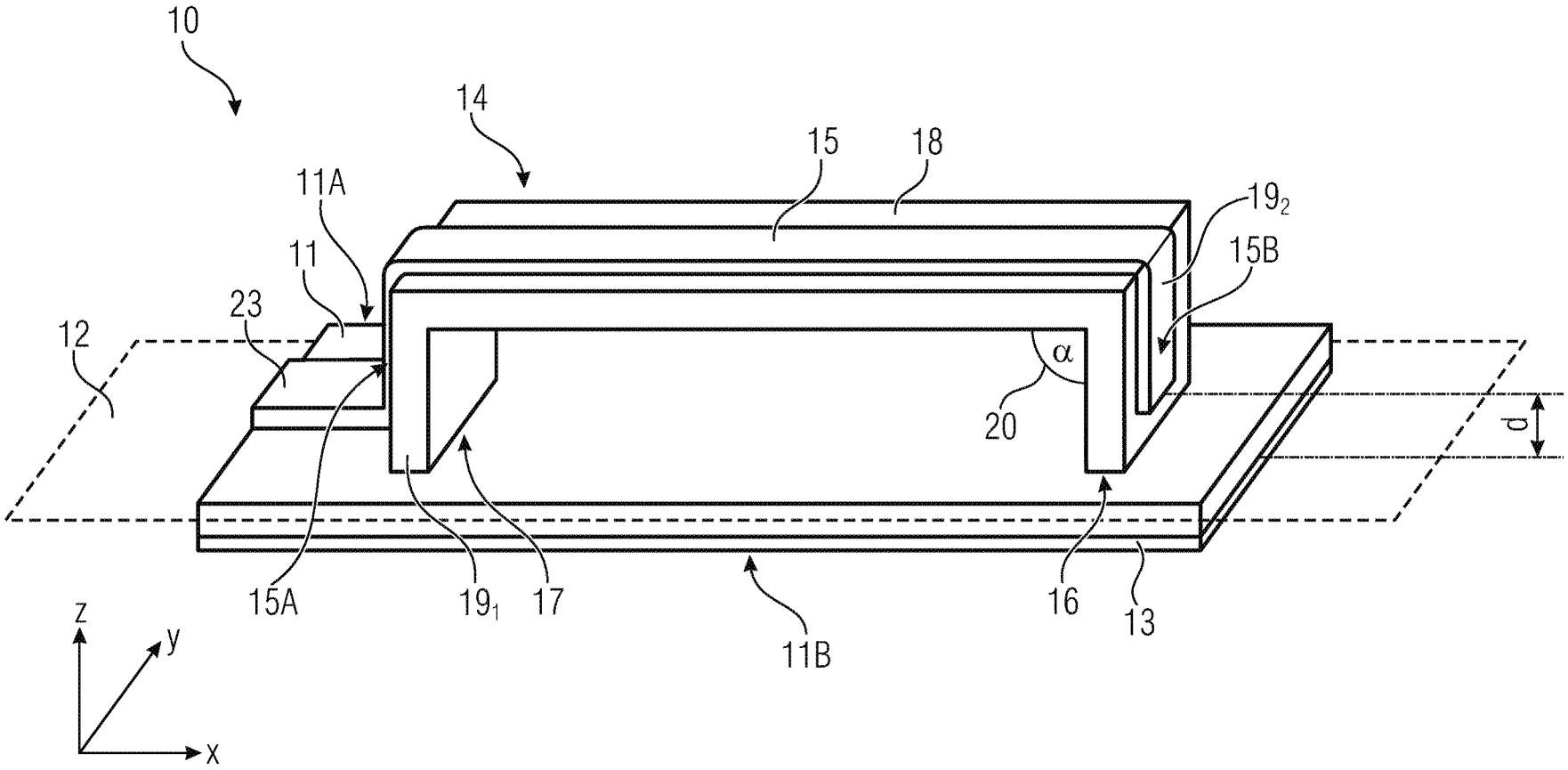
FIG. 1 shows a schematic perspective view of an antenna device in accordance with an embodiment.

Embodiments will be described below in more detail with reference to the figures, wherein elements having identical or similar functions are provided with identical reference numerals.

The antenna device will initially be described in terms of structure while referring to the figures.

In addition, the three-dimensional shape structure here will be described, by way of example, by using a three-dimensional shape structure that is curved to be convex as well as an angular three-dimensional shape structure. The geometric shape of the three-dimensional shape structure is not limited thereto, however, but may comprise any other shapes, for example concave, continually or discontinuously straight and/or curved, in particular round or elliptical, and/or a combination thereof.

FIG. 1 shows an embodiment of an inventive antenna device 10. The antenna device 10 comprises a substrate 11. As is depicted, the substrate 11 may have a planar shape. Alternatively, however, the substrate 11 may also have a geometric shape deviating from the planar shape, and may be configured to be curved, kinked, arched or the like.

The substrate 11 extends within a two-dimensional substrate plane 12. The two-dimensional substrate plane 12 may concentrically extend through the substrate 11 along the main extension direction of the substrate 11 and intersect the substrate 11 in a lengthwise manner, as depicted. Thus, the substrate plane 12, too, may be configured to be planar or may be geometrically configured in a shape deviating from the planar shape. The second side of the substrate has a rear-side metallization 13 arranged thereon which extends over the entire surface area or at least over a large surface area, at at least 50%, 60% or 80%, across the side 11B within the area of the antenna structures.

The substrate 11 comprises a first side 11A and an oppositely arranged second side 11B. A three-dimensional shape structure 14 is arranged on the first side 11A of the substrate 11. The three-dimensional shape structure 14 extends out of the two-dimensional substrate plane 12. This means that the two-dimensional substrate plane 12 extends in first and second directions (e.g., x and y directions), and the three-dimensional shape structure 14 additionally extends in a third direction (e.g., z direction). This may be transferred, without any restrictions, to a non-planar substrate plane 12 wherein the three-dimensional shape structure 14 protrudes from said very non-planar substrate plane.

The three-dimensional shape structure 14 has an electrically conductive strip structure 15 arranged thereon which extends between a first end 15A and a second end 15B of the electrically conductive strip structure. Said electrically conductive strip structure may include, for example, one or more metal materials, one or more doped semiconductor materials, and/or a combination thereof. The material used, or the combination of materials used, may be electrically conductive and is advantageously low in resistance.

The rear-side metallization 13 is advantageously arranged such that an area, into which the strip structure 15 is projected into side 11B by means of projection along a surface normal of side 11B of the substrate 11, is covered by the rear-side metallization 13 to an extent of at least 80%, at least 90% or at least 95%, advantageously completely.

The first end 15A may be connected to a supply line 23, for example at the location or within an area of a connection of the strip structure 15. Alternatively, the end 15A may also be determined by the location where the obtained antenna structure protrudes from the substrate plane 12 on the basis of the supply line 23.

Together with the rear-side metallization 13, the strip structure 15 may form a loop antenna. To this end, the strip structure 15 is electrically connected to the rear-side metallization 13. The strip structure 15 may be capacitively or galvanically coupled to the rear-side metallization 13.

The embodiment shows capacitive coupling in accordance with which the strip structure 15 is galvanically separated from the rear-side metallization. A distance d between the second end 15B and the rear-side metallization may be set such that when the antenna device has an electric signal applied thereto which comprises a signal frequency (transmitter), or has an electromagnetic signal applied thereto (receiver), a desired electric property is obtained. In accordance with an embodiment, the distance d is set to be as small as possible, for example is set to correspond to a thickness of the substrate 11. In this case, the strip structure 15 would reach down as far as the side 11A or even reach into the substrate 11. In other words, the end 15B may also be arranged within or on a surface area of the side 11A.

For galvanic coupling in accordance with an embodiment, the antenna device comprises, e.g., a via extending through the substrate 11 between the end 15B and the rear-side metallization 13.

An area of the three-dimensional shape structure 14 and/or of the strip structure 15 may define an antenna area where the second side 11B of the substrate 11 is covered by the rear-side metallization 13 over a large surface area or over the entire surface area. The strip structure 15 may be flexible. The strip structure 15 may conform with the three-dimensional shape structure 14, i.e., the strip structure 15 arranged on the three-dimensional shape structure 14 may adopt the same shape as the three-dimensional shape structure 14 itself, or at least as that portion 18 of the three-dimensional shape structure 14 which has the strip structure 15 arranged thereat. The strip structure 15 may be attached to the portion 18 by means of methods such as metal deposition, in particular copper deposition, an adhesive method and/or any other mechanical type of attachment. It is also possible for the three-dimensional shape structure 14 to be formed of a circuit-board substrate, so that the strip structure 15 is formed of a layer of the circuit-board substrate.

In the embodiment depicted here, the three-dimensional shape structure 14 has an angular shape. The three-dimensional shape structure 14 may comprise a first portion 18 extending approximately in parallel with the substrate 11. In addition, the three-dimensional shape structure 14 may comprise two support structures $\mathbf{19}_1$, $\mathbf{19}_2$, which connect the first portion 18 to the substrate 11 while keeping the first portion 18 spaced apart from the substrate 11. The support structures $\mathbf{19}_1$, $\mathbf{19}_2$ may extend at an angle 20 in relation to the first portion 18 and/or may extend perpendicularly to the substrate 11. Generally, the angle 20 may amount to from 1° to 179°, from 10° to 170° or from 120° to 60° for both support structures $\mathbf{19}_1$, $\mathbf{19}_2$. In the embodiment depicted here, the angle may be 90°, for example.

The three-dimensional shape structure 14 also comprises a first substrate contact portion 16 and a second substrate contact portion 17. This means that the three-dimensional shape structure 14 is physically in contact with the substrate 11 both at the first substrate contact portion 16 and at the second substrate contact portion 17. In the embodiment depicted, for example, the two support structures $\mathbf{19}_1$, $\mathbf{19}_2$ of the three-dimensional shape structure 14 comprise substrate contact portions 16, 17 and are additionally physically in contact with the substrate 11. In a previously mentioned capacitive coupling between the strip structure 15 and the rear-side metallization 13 with a small distance d, the end 15B may be arranged in the area of the substrate contact portion 16.

The three-dimensional shape structure 14 three-dimensionally extends between the first substrate contact portion 16 and the second substrate contact portion 17. This means that the three-dimensional shape structure 14 longitudinally extends in parallel with the substrate plane 12 in a first and/or second direction (e.g., in the x and/or y direction(s)) while being spaced apart from the substrate 11, specifically in a third direction (e.g., z direction).

It is between the first substrate contact portion 16 and the second substrate contact portion 17 that the strip structure 15 is arranged on the three-dimensional shape structure 14, specifically in a main extension direction. The main extension direction may also be understood as an axial extension direction and may be an expansion of the strip structure 15 between the first end 15A and the second end 15B, along which the strip structure extends axially, e.g., along the x direction. The strip structure 15 may also be arranged differently in the space, however. Within the framework of a non-restricting example, the expansion or extension of the strip structure 15 along the x direction is understood to be the largest expansion of the strip structure 15 and is referred to as the length of the strip structure 15. An expansion or dimension that is perpendicular thereto and is possibly parallel to the substrate plane 12 is referred to as the width and is smaller than the length. A third expansion perpendicular to the length and perpendicular to the substrate plane 12, e.g., along the z direction, is understood to be the thickness. The length may be larger, e.g., by at least one order of magnitude, i.e., by at least a factor of 10, than the width and/or the height of the strip structure 15. The width and/or height may at least influence a cross section of the strip structure 15 and may also set an impedance of the antenna via the cross section. The length of the strip structure may influence or even determine an antenna frequency of a signal received or sent by the strip antenna.

The antenna end 15A is electrically coupled to a supply line 23, so that the loop of the loop antenna including the strip structure 15 and the rear-side metallization 13 is closed. The second antenna end may, in various configurations of the antenna device, be either capacitively coupled to the rear-side metallization 13 or galvanically coupled thereto, e.g., by means of a via.

Via the supply line 23, the loop antenna may be electrically connected to a further structure, e.g., to a high-frequency chip. The loop antenna may provide, for the further structure, e.g., a transmit antenna and/or a receive antenna. In this manner, a signal that is to be sent from the loop antenna via the supply line 23 may be sent to the strip structure, and/or a wireless signal may be received by the strip structure 15, and an electric signal subsequently obtained may be provided at the supply line 23.

In the embodiment depicted here, the three-dimensional shape structure 14 extends across a surface area of the substrate, or of the side 11A, i.e., it is spaced apart from the side 11A in some areas. As a result, the strip structure 15 extends within a plane that may extend outside the substrate plane 12, e.g., in parallel with the substrate plane 12.

As a result of the planar configuration of the substrate and, therefore, of the rear-side metallization, simple contacting of the antenna structure with an electric device may be effected. Such an electric device may comprise, e.g., a high-frequency chip providing a high-frequency signal to be sent. Alternatively or additionally, the chip may also receive a high-frequency signal. The high-frequency chip may be part of a circuit board arrangement. Said circuit board arrangement may readily have the antenna device integrated therein because of its planar rear-side implementation, whereas the three-dimensional configuration enables high radiation quality on the front side.

Figure 2A:
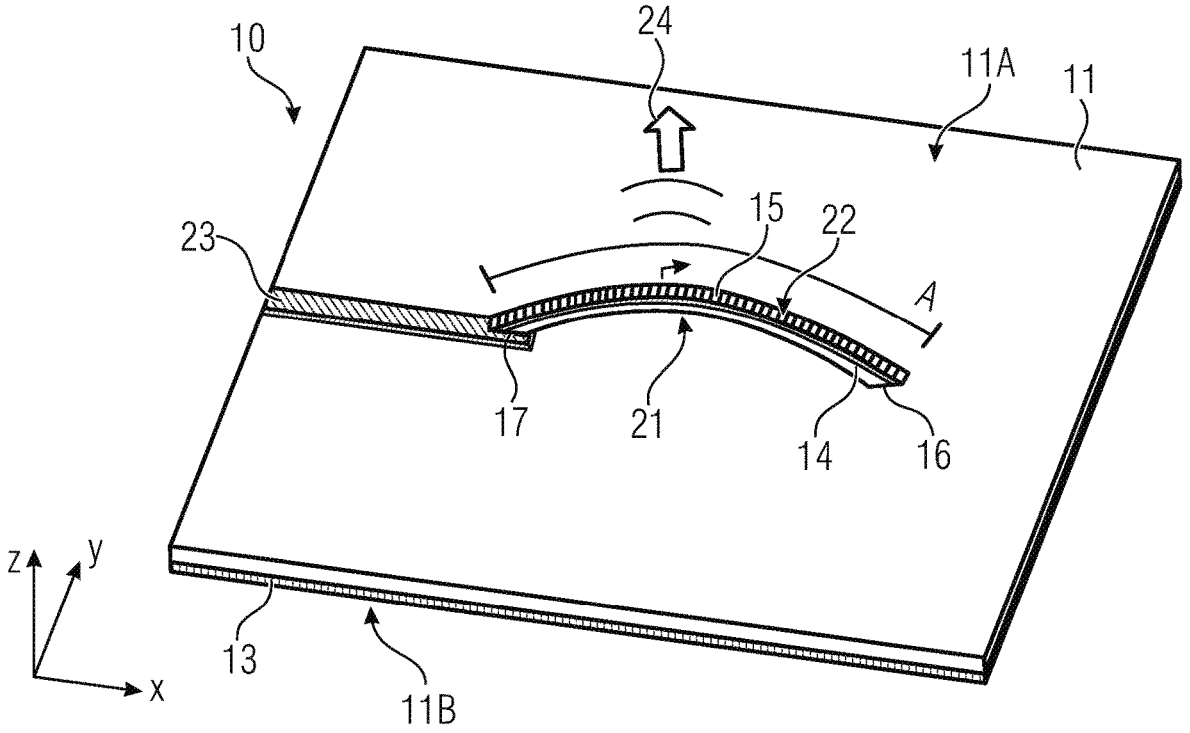
FIG. 2A shows a schematic perspective view of the antenna device in accordance with a configuration.
Figure 2B:
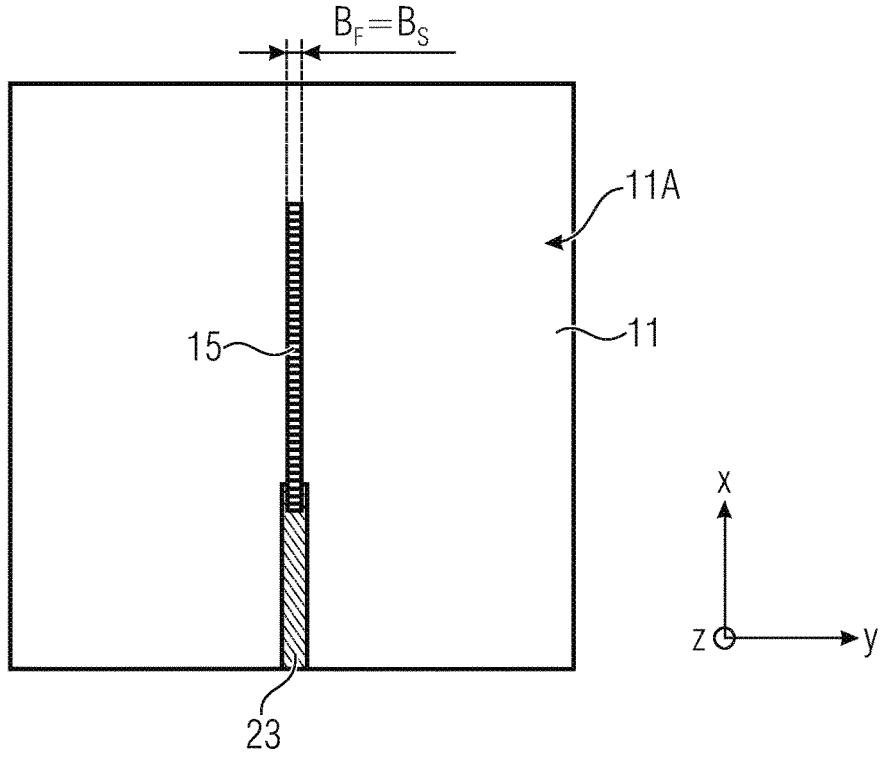
FIG. 2B shows a schematic top view of the configuration of FIG. 2A.

FIG. 2A shows a schematic perspective view of the antenna device 10 in accordance with a configuration. FIG. 2B shows a schematic top view of the configuration of FIG. 2A. In accordance with the embodiment, the three-dimensional shape structure 14 is continuously curved at least on the side 21, so that the strip structure 15, too, is continuously curved. A length A of the strip structure 15 extends between the substrate contact portions 16 and 17 and forms part of the loop antenna within that area which protrudes from the substrate plane. The length A may be selected, e.g., to roughly correspond, for example, to an eighth ($\lambda/8$), a quarter ($\lambda/4$), half ($\lambda/2$) or the total amount ($\lambda$) or a multiple ($\times\lambda$), e.g. $3/2\lambda$, of a center frequency of a signal to be sent or to be received.

The supply line 23 may be arranged, in a planar manner, on that side 11A of the substrate 11 which is located opposite the rear-side metallization 13. In other configurations, wherein the supply line 23 also extends onto the three-dimensional shape structure, it may also act as part of the antenna structure in that area. Similarly, a part of the strip structure 15 which extends on the side 11A in a planar manner, may be understood to be the supply line.

A first antenna terminal may be galvanically connected to the strip structure 15, for example by means of the supply line 23. A second antenna terminal may be galvanically connected to the rear-side metallization. The loop antenna may be operated by connecting a signal source or a signal drain to the first and second antenna terminals, for example in that an electric alternating signal is applied between the two terminals or is received from there.

The strip antenna may be configured, for example, to emit a radio signal, e.g., along a main radiation direction 24 and/or to receive a radio signal from said direction. The strip structure may extend in the axial direction, e.g., along the x direction, across the entire course of the strip structure, so that an electric connection between the strip structure 15 and the supply line may be arranged, e.g., at the location of the substrate contact portion 17. Alternatively, electric contacting of the strip structure 15 may also be performed differently, e.g., by means of a via, so that the supply line may also be arranged inside the substrate 11 or on the rear side 11B.

As depicted in FIG. 2B, a width $B_F$ of the three-dimensional shape structure 14 along the y direction may essentially correspond to, i.e., within a tolerance range of 10%, 5%, 2% or less, e.g., 0%, of the width $B_S$ of the strip structure 15, which facilitates a small amount of material expenditure.

Unlike in FIG. 1, where the strip structure 15 extends within a plane parallel to the substrate plane (12), the strip structure 15 may also extend within a plane that does not extend in parallel in relation to the substrate plane (12), for example when the three-dimensional shape structure is curved in relation to the substrate plane 12.

The three-dimensional shape structure 14 comprises a first side 21 and an oppositely arranged second side 22. The first side is arranged to be located opposite the substrate 11 and faces the side 11A. The second side 22 faces away from the side 11A. The strip structure 15 is arranged on the second side 22 of the three-dimensional shape structure 14.

In the embodiment depicted in FIGS. 2A and 2B, the three-dimensional shape structure 14 forms an arc which spans the first substrate contact portion 16 and the second substrate contact portion 17 across the substrate 11. In this embodiment, therefore, the strip structure 15 extends within a second plane, which extends in a curved manner in relation to the substrate plane 12. However, it would also be feasible for said second plane to comprise at least one kink in addition or alternatively to a curvature.

As shown in FIGS. 1, 2A and 2B, the substrate 11 and the strip structure 15 may be arranged one above the other in the third direction (z direction). For example, the substrate 11 and the strip structure 15 may be arranged one above the other in a direction perpendicular to the substrate plane 12.

Figure 3A:
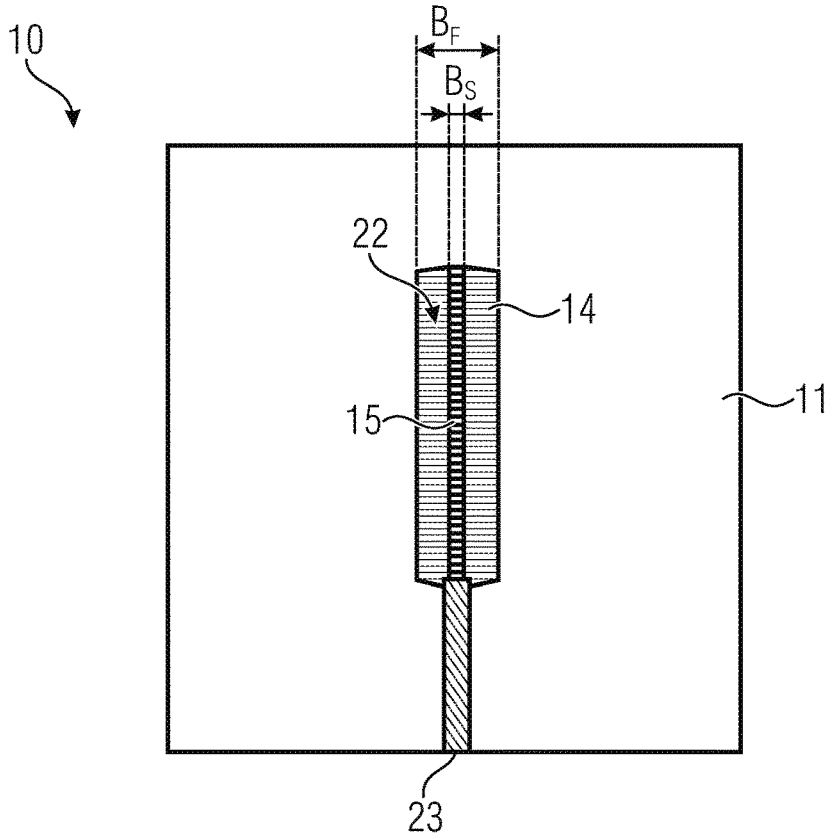
FIGS. 3A-B show a further embodiment of the present invention with a three-dimensional shape structure configured in the shape of an arc.
Figure 3B:
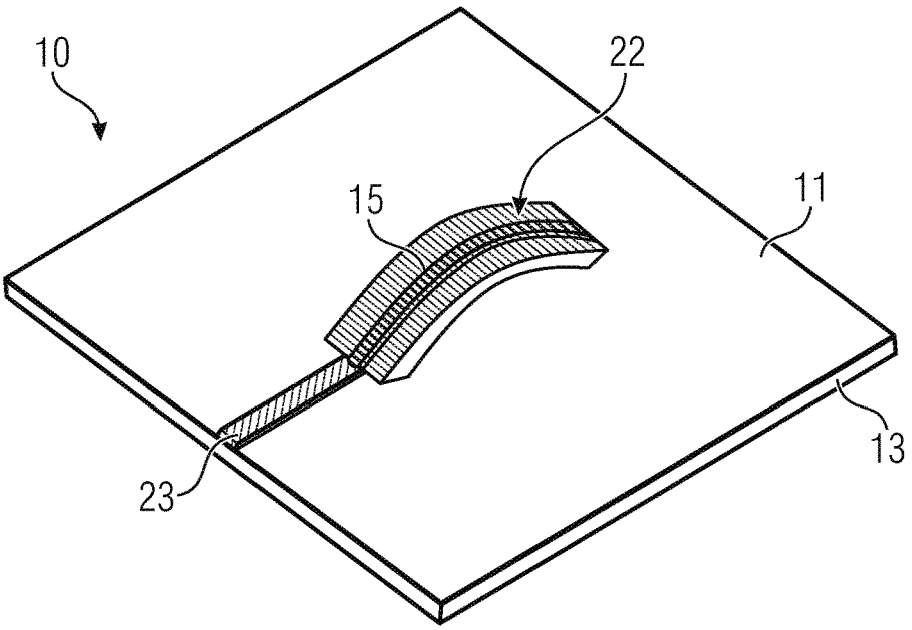

FIGS. 3A and 3B shows a further embodiment of the present invention which has an also arch-shaped three-dimensional shape structure 14. The width $B_F$ of the three-dimensional shape structure 14 is larger than the width $B_S$ of the strip structure 15, i.e., $B_F > B_S$. The width $B_F$ may be larger than the width $B_S$ by at least 10%, at least 20% or at least 50%. An increasingly large width enables increasingly higher mechanical stability, for which purpose additional expenditure in terms of material may be accepted. Also, an additional width $B_F$ may result in increasing attenuation of the transmit signal of the strip antenna.

Figure 4:
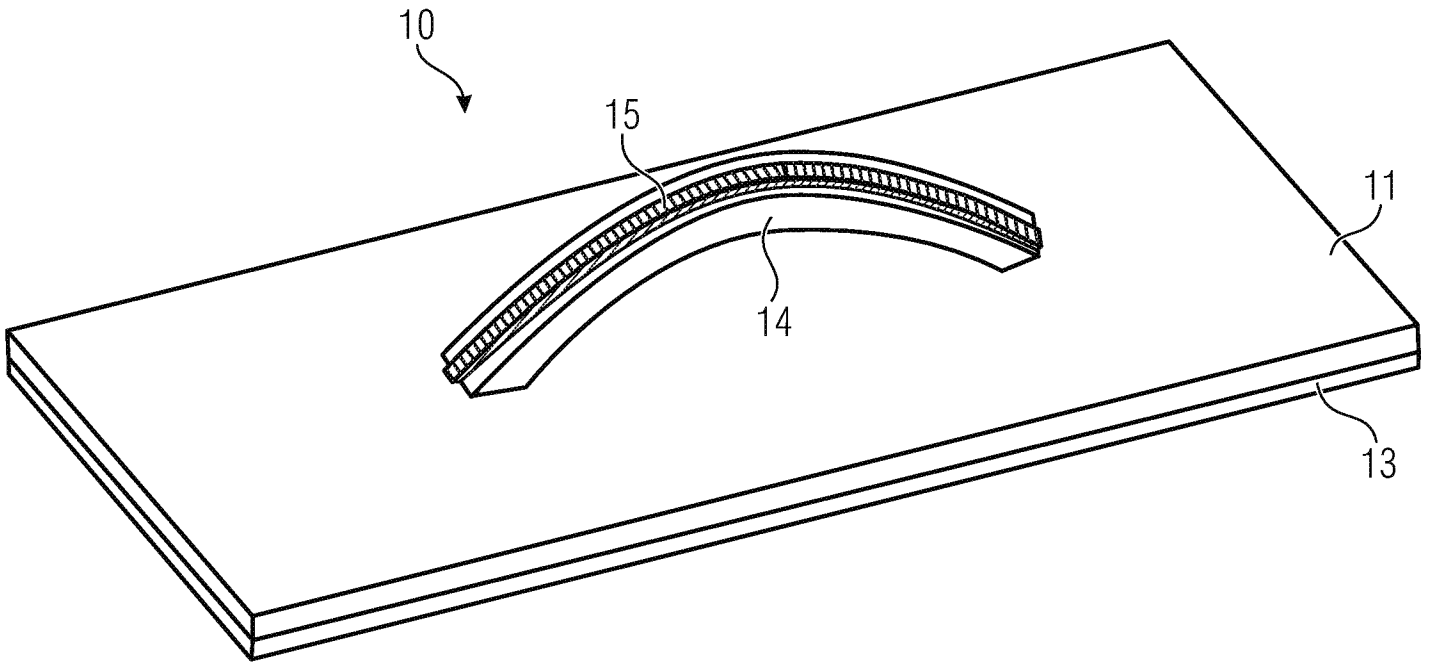
FIG. 4 shows a schematic perspective view of the antenna device in accordance with a further embodiment, wherein a supply line on the front side of the substrate is not required since the strip structure is connected to the supply line by means of a via.
Figure 5A:
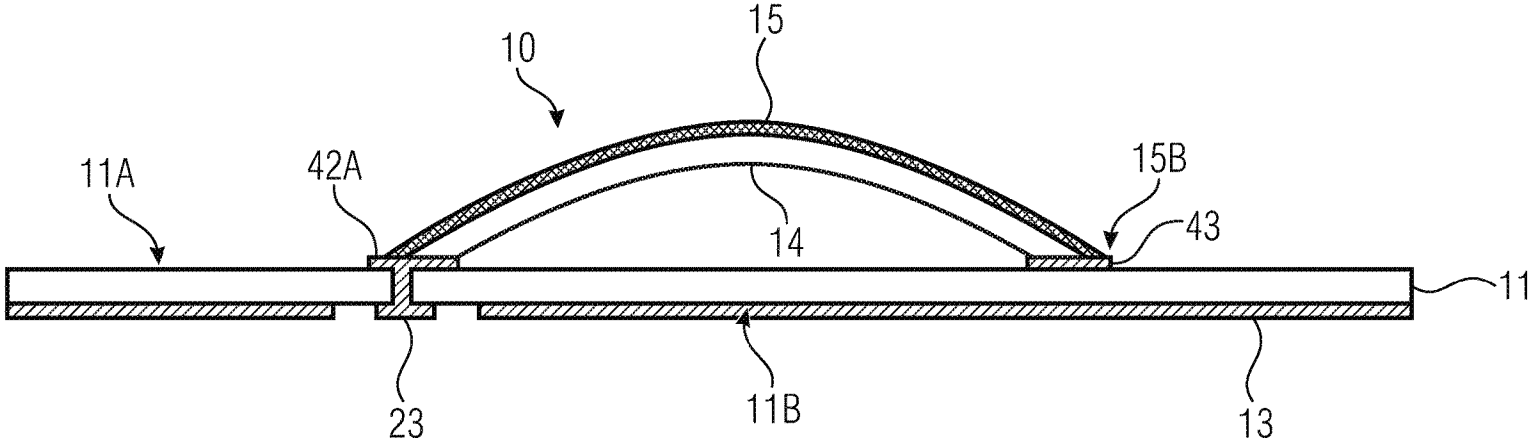
FIGS. 5A-B show configurations of the via of FIG. 4.
Figure 5B:
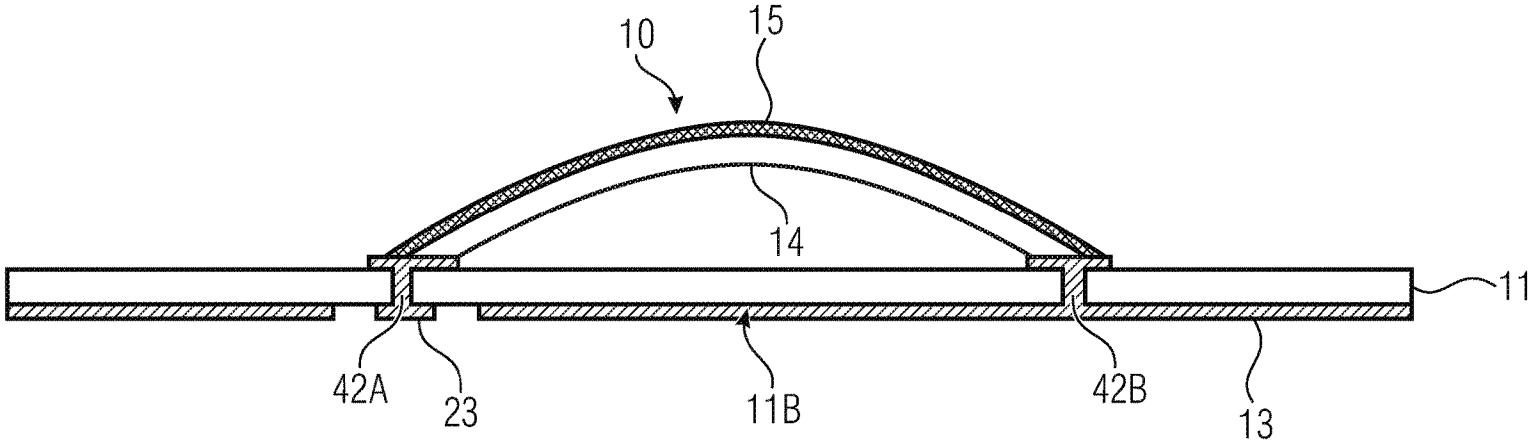

FIG. 4 shows a schematic perspective view of the antenna device 10 in accordance with a further embodiment, wherein a supply line on the side 11A is not required since the strip structure 15 is connected to the supply line 23 by means of a via 42A shown in more detail in FIGS. 5A and 5B. In this case, the supply line 23 is arranged on the second side 11B.

FIG. 5A shows a schematic sectional side view of the antenna device 10, wherein the via 42A enables contacting of the strip antenna through the substrate plane. At the same time, the second end 15B of the strip structure 15 is connected to the substrate 11 while using an attachment area 43. Said attachment area 43 may be configured, for example, as a metallization, e.g., a bonding pad or the like, and is arranged on the first side 11A. In the absence of a via, the end 15B and the attachment area are galvanically separated from the rear-side metallization 13 and are capacitively coupled.

When an electric alternating voltage is applied to the antenna structure, e.g., by applying an alternating voltage between the supply line 23 and the rear-side metallization, a resonating current loop may be obtained, by means of a displacement current, which acts as an antenna if the device has a length of, e.g., $\lambda/2$. It shall be noted that a location of the supply line 23 may also be on the side 11A without changing the functionality. FIG. 5B shows a schematic sectional side view of the antenna device 10 in a configuration that is an alternative of FIG. 5A and wherein the end 15B of the strip structure 15 is electrically connected, advantageously in a low-ohmic manner, to the rear-side metallization 13 while using a via 42B.

Figure 6A:
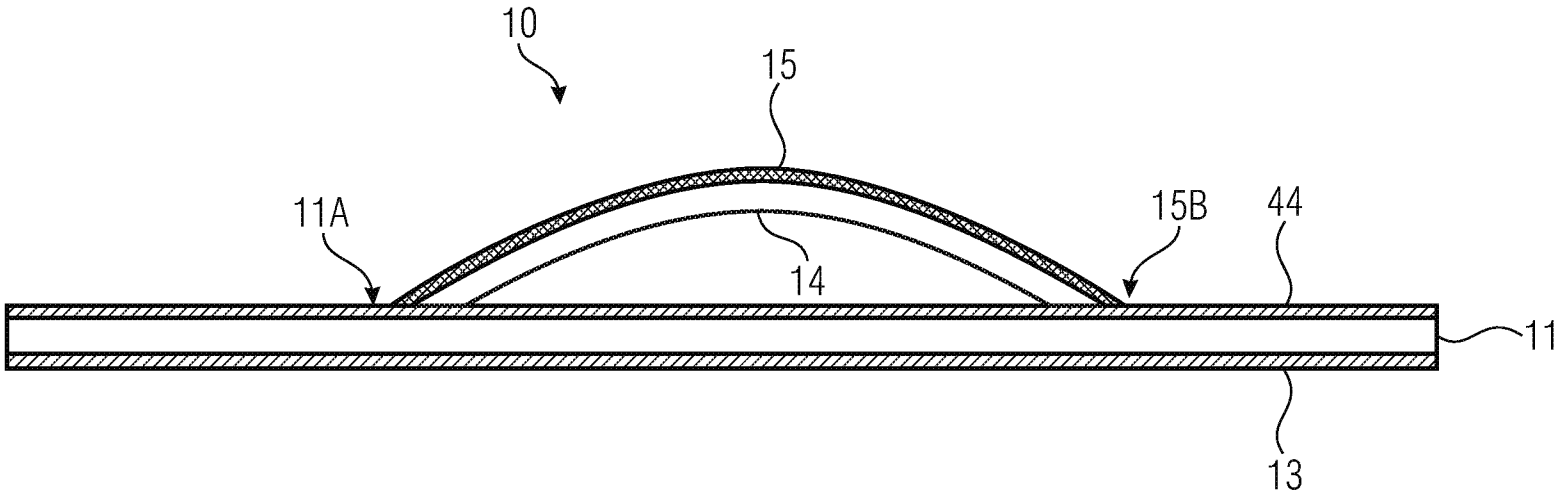
FIG. 6A shows a schematic sectional side view of the antenna device in a further design in accordance with an embodiment, wherein a front-side metallization is arranged on the front side of the substrate which encompasses the supply line at least in some areas.

FIG. 6A shows a schematic sectional side view of the antenna device 10 in a further configuration in accordance with an embodiment, wherein a front-side metallization 44 is arranged on the first side 11A which encloses at least some areas of the supply line so as to obtain co-planar supply of the loop antenna. For this purpose, the end 15B of the strip structure 15 is electrically connected to the front-side metallization 44, so that the front-side metallization 44 enables returning electric currents from the strip structure 15. The front-side metallization 44 may cover the entire surface area, or at least the large part of the surface area, of the first side 11A of the substrate 11 at least in an area of the antenna device 10, for example to an extent of at least 50%, at least 60%, or at least 70%. Alternatively, a smaller extent is also possible, as described by means of FIGS. 7A to 7C.

Figure 6B:
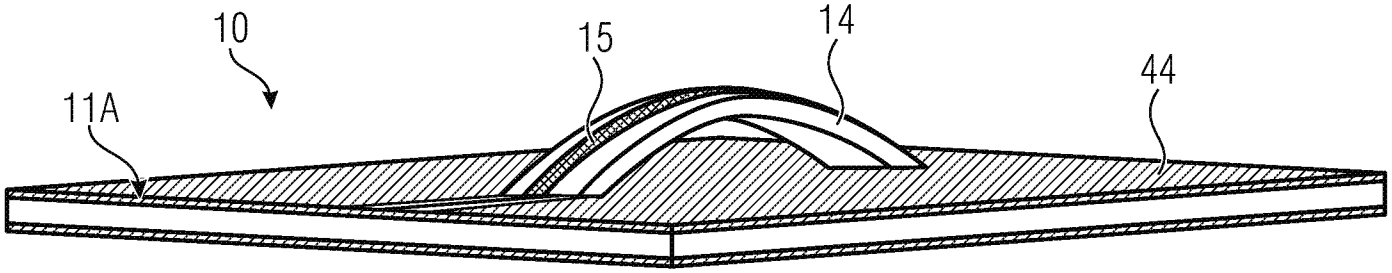
FIG. 6B shows a schematic perspective view of the antenna device of FIG. 6A.

FIG. 6B shows a schematic perspective view of the antenna device 10 of FIG. 6A.

Figure 6C:
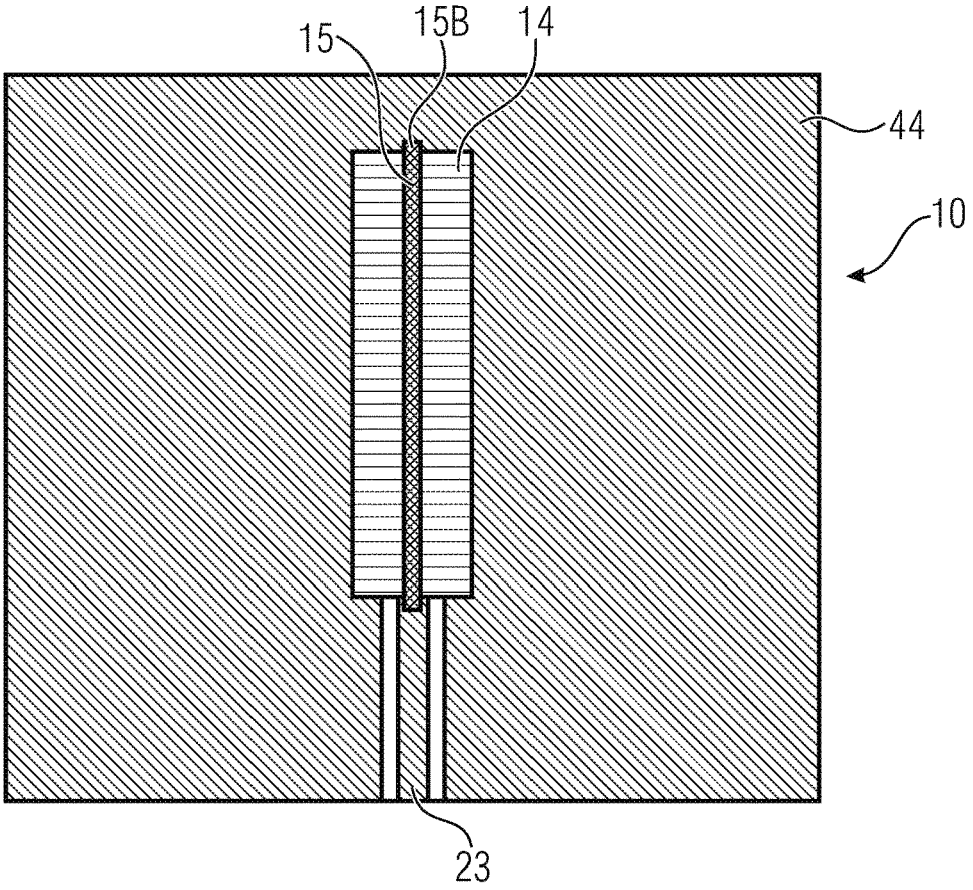
FIG. 6C shows a schematic top view of the antenna device of FIG. 6A.

FIG. 6C shows a schematic top view of the antenna device 10 of FIG. 6A.

Figure 6D:
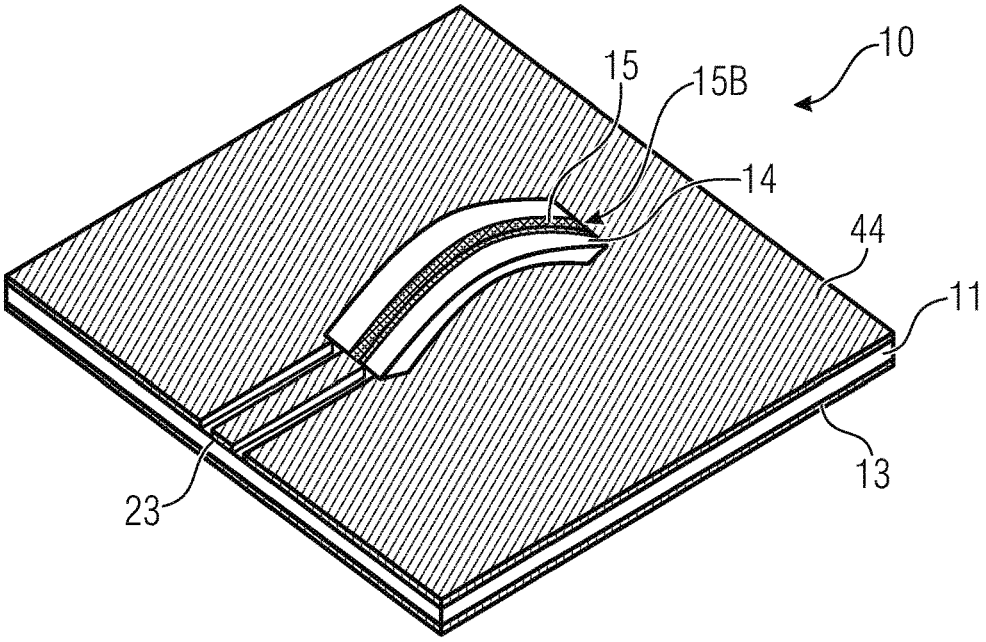
FIG. 6D shows a further schematic perspective view of the antenna device of FIG. 6A.

FIG. 6D shows a further schematic perspective view of the antenna device 10 of FIG. 6A.

Figure 7A:
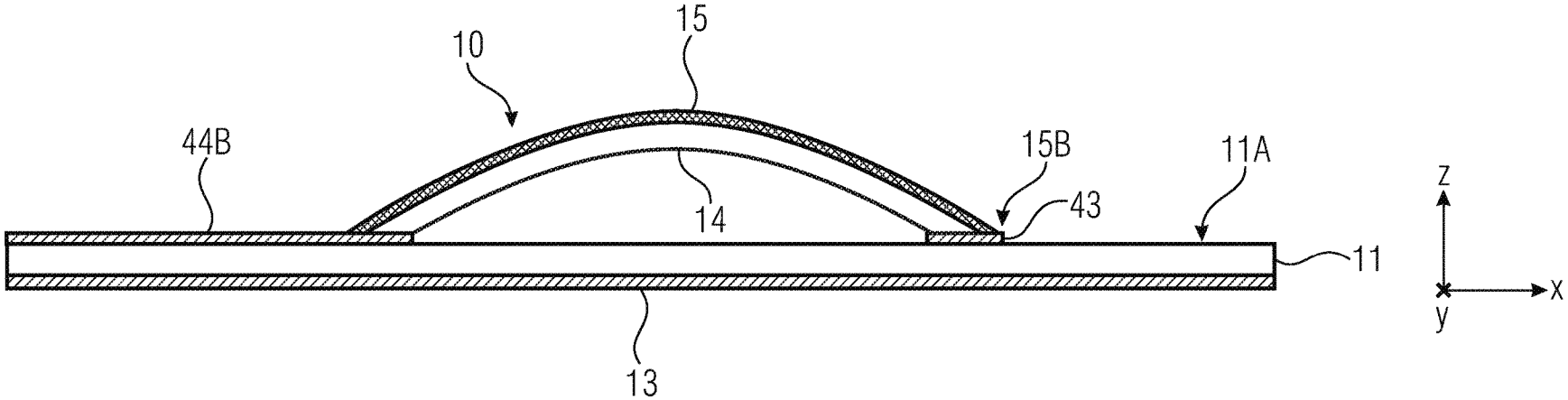
FIG. 7A shows a schematic sectional side view of an inventive antenna device, wherein the front-side metallization covers merely a partial area of the front side of the substrate.

FIG. 7A shows a schematic sectional side view of the antenna device 10, wherein the front-side metallization 44 covers merely a partial area of the first side 11A, e.g., 50% at the most, 40% at the most, or 30% at the most, or less. Irrespective of the extent of the surface-area covering, the front-side metallization 44 may consist of one piece, as depicted in FIGS. 6A to 6D, or may consist of several pieces and may comprise at least two, at least three or a higher number, e.g., four, segments, as described, e.g., for segments 44A and 44B in FIG. 7C.

In accordance with FIG. 7A, the second end 15B of the strip structure 15 is electrically connected to the attachment area 43 arranged on the first side 11A. In accordance with the embodiment shown in FIG. 7B, the second end 15B of the strip structure 15 is electrically connected to the via 42B configured to electrically connect the second end 15B to the rear-side metallization 13. This may also be understood to mean that the antenna device of FIGS. 6A to 6C may be configured to comprise front-side metallization which fully or partly covers the side 11A of the substrate 11 in one piece or in several pieces.

Figure 7B:
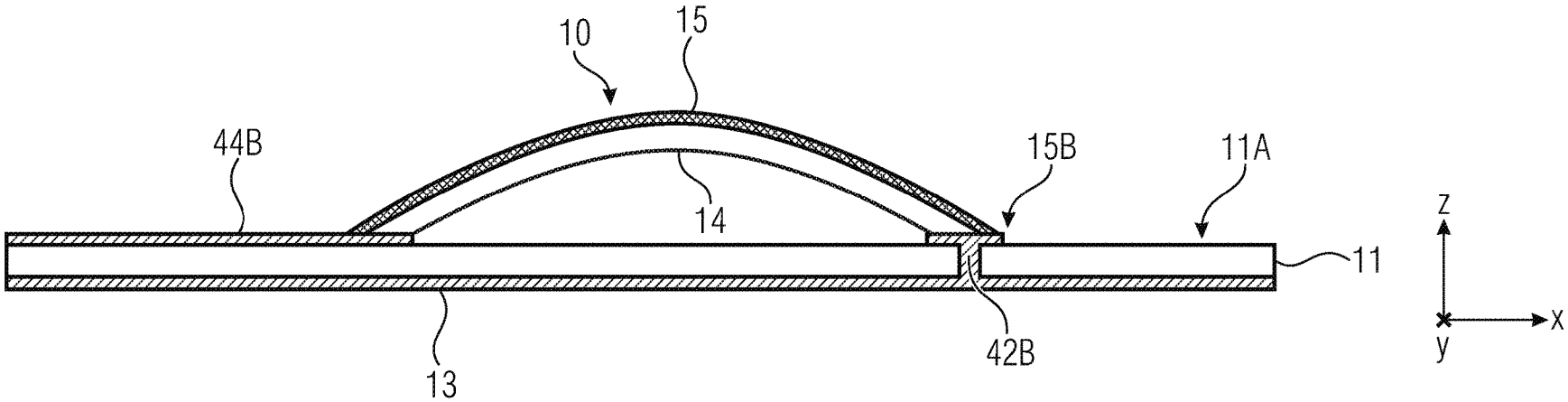
FIG. 7B shows a schematic sectional side view of an inventive antenna device wherein the second end of the loop antenna is electrically connected to the via.
Figure 7C:
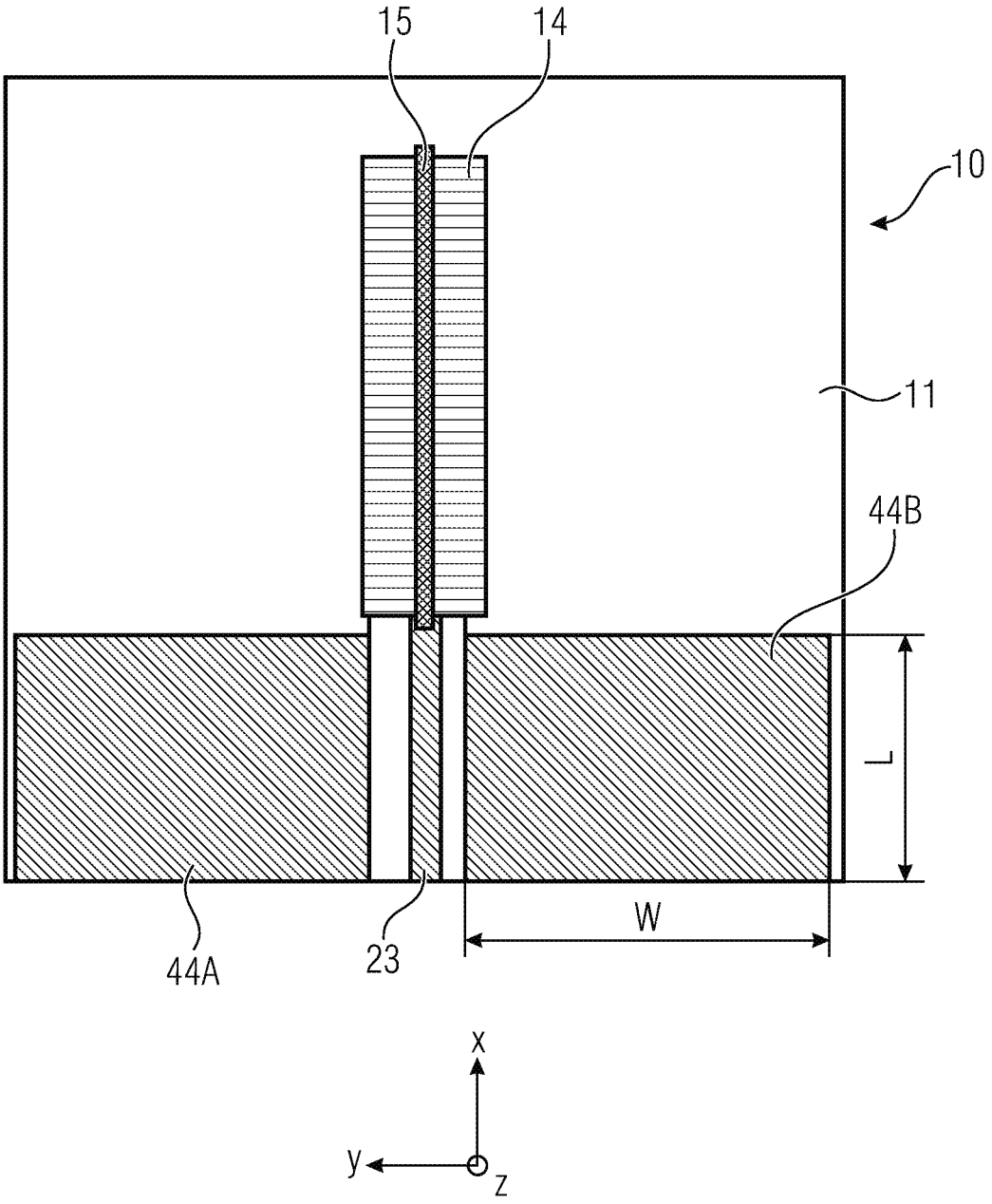
FIG. 7C shows a schematic top view of the antenna device of FIG. 7A or 7B.

FIG. 7C shows a schematic top view of the antenna device of FIG. 7A or 7B, wherein the segments 44A and 44B are arranged to be laterally adjacent to the supply line 23, so that the supply line 23 is surrounded, along an axial extension direction, e.g., the x direction, by the front-side metallization segments 44A and 44B to an extent of at least 20%, at least 50%, or at least 80% or more. Thus, the segments may also provide a metallization face and may provide impedance matching of the supply line 23 and/or of the loop antenna and/or be electrically connected to a reference potential. A degree of the impedance matching may be effected by configuring a length L along the x direction and a width W along the y direction. Impedance matching may be effected by varying the distance between the signal line and the reference, and by means of the substrate thickness and the width of the ground plane. The segments may be galvanically connected to one another either directly, e.g., via electrically conductive connecting structures, or via a common electric potential.

Figure 8A:
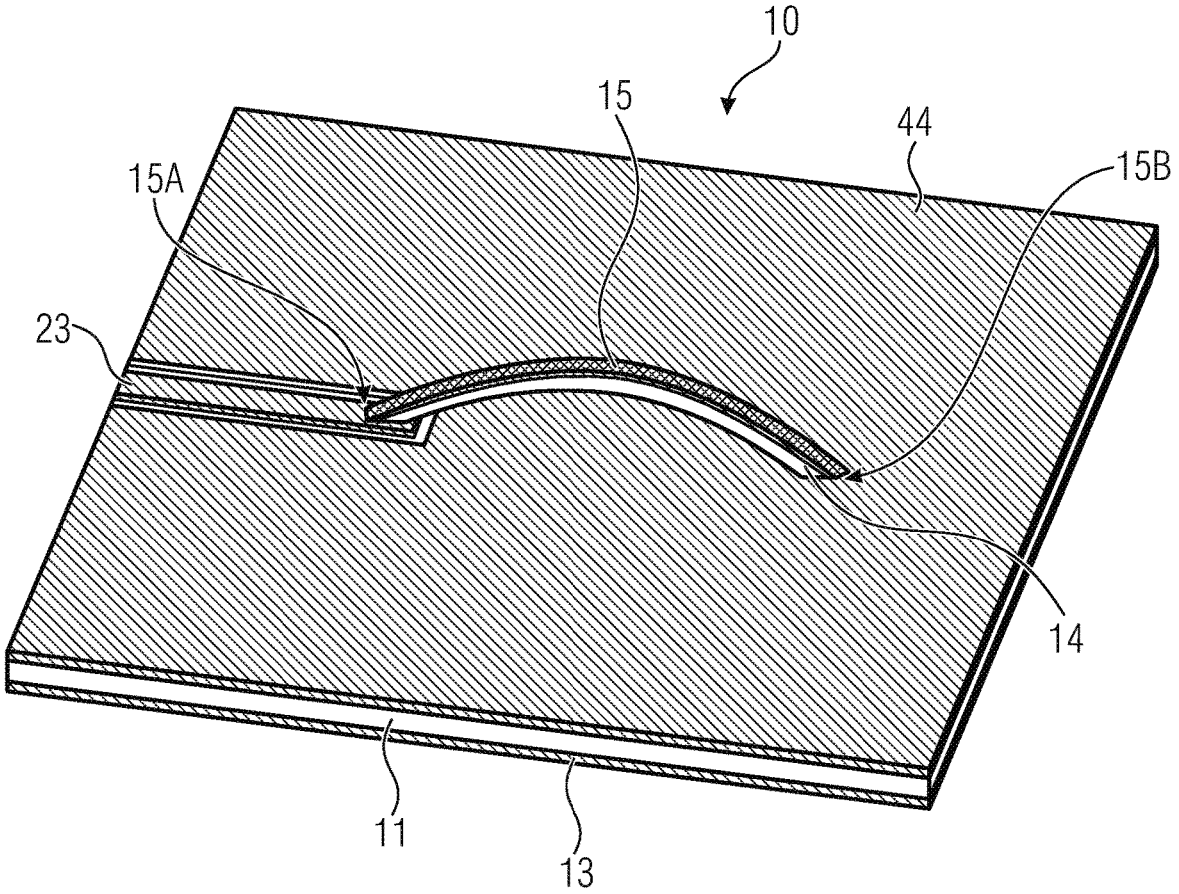
FIG. 8A shows a schematic perspective view of an inventive antenna device wherein the front side of the substrate has the front-side metallization arranged thereon.
Figure 8B:
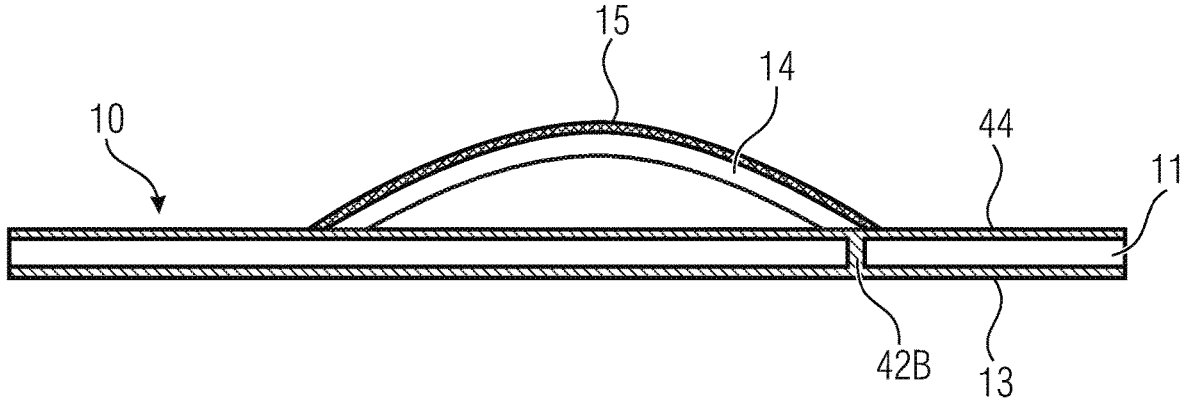
FIG. 8B shows a schematic sectional side view of the antenna device of FIG. 8A.

FIG. 8A shows a schematic perspective view of the antenna device 10 in a configuration, wherein the first side 11A has the front-side metallization 44 arranged thereon which is further electrically connected to the rear-side metallization 13 by means of the via 42B, as is depicted by means of FIG. 8B. Even though the three-dimensional shape structure 14 is shown such that the width essentially corresponds to the width of the strip structure 15, it is also possible to use a smaller, but in particular a larger, width.

Figure 9A:
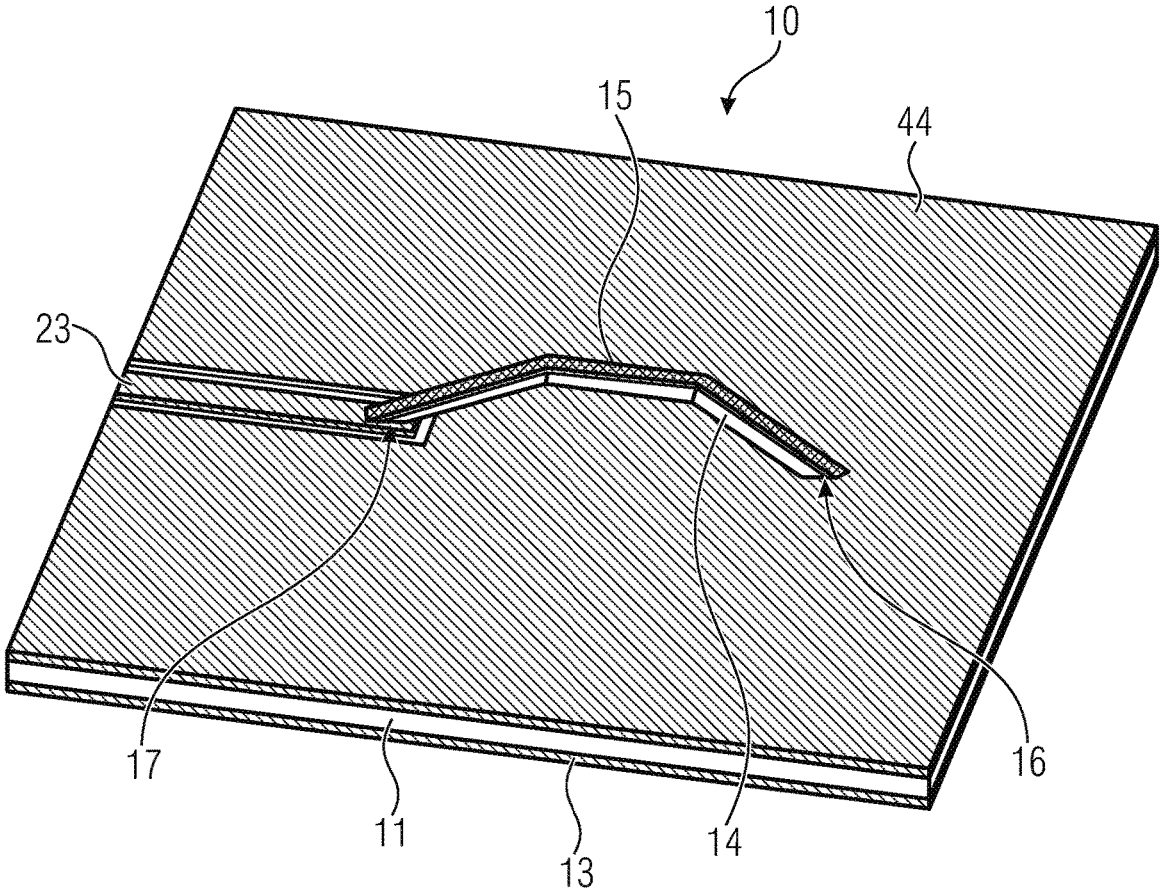
FIG. 9A shows a schematic perspective view of an inventive antenna device with an angular three-dimensional shape structure.
Figure 9B:
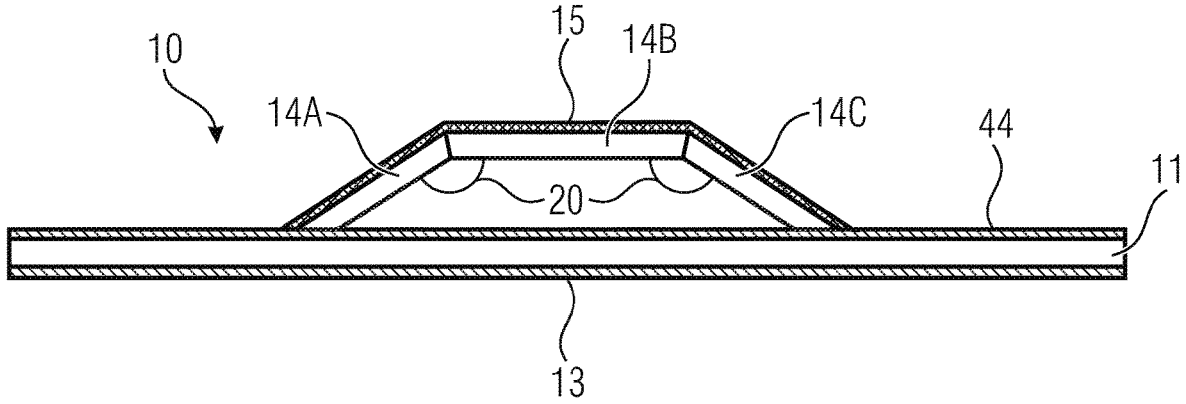
FIG. 9B shows a schematic sectional side view of the antenna device of FIG. 9A.

FIG. 9A shows a schematic perspective view of the antenna device 10 in a configuration having widths which match each other with regard to the three-dimensional shape structure 14 and to the strip structure 15, and having the front-side metallization 44. The front-side metallization 44 is, e.g., galvanically separated from the rear-side metallization 13, as depicted in FIG. 9B. Irrespective thereof, the three-dimensional shape structure 14 is formed by stitching of several shape segments 14A to 14C which are straight at least in portions. A number of the shape segments 14A to 14C may have any value of at least 1, at least 2, at least 3 or more, wherein each segment may be straight, kinked or curved. As compared to FIG. 1, the angle 20 may currently amount to 120°, for example; unequal angles may also be present between segments 14A and 14B and between segments 14B and 14C, respectively.

The strip structure 15 may extend across several segments 14A to 14C and may, e.g., fully extend between the substrate contact portions 16 and 17 or may almost fully extend, i.e., in the amount of at least 70%, at least 80%, or at least 90% of the distance, present on the three-dimensional shape structure, between the substrate contact portions 16 and 17.

Figure 10A:
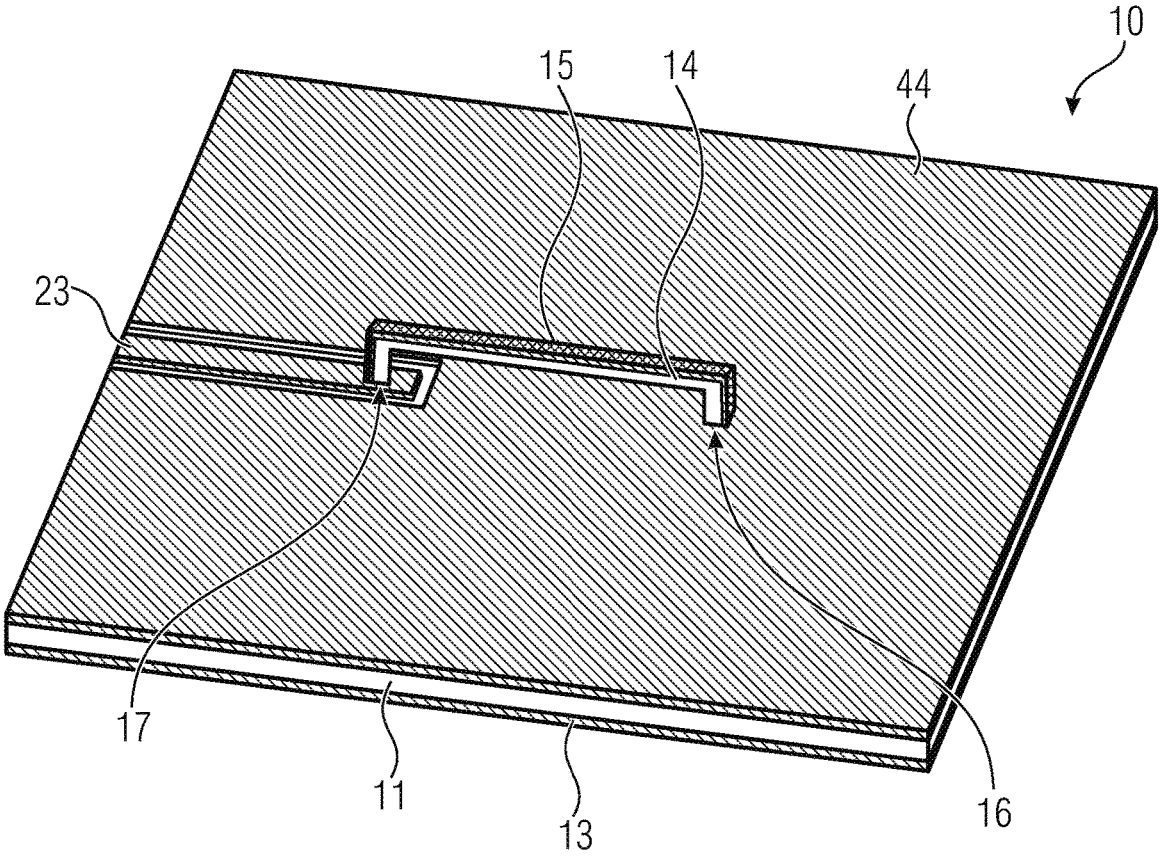
FIGS. 10A-B show schematic views of an inventive antenna device wherein angles between portions of the three-dimensional shape structure comprise a value of 90°.
Figure 10B:
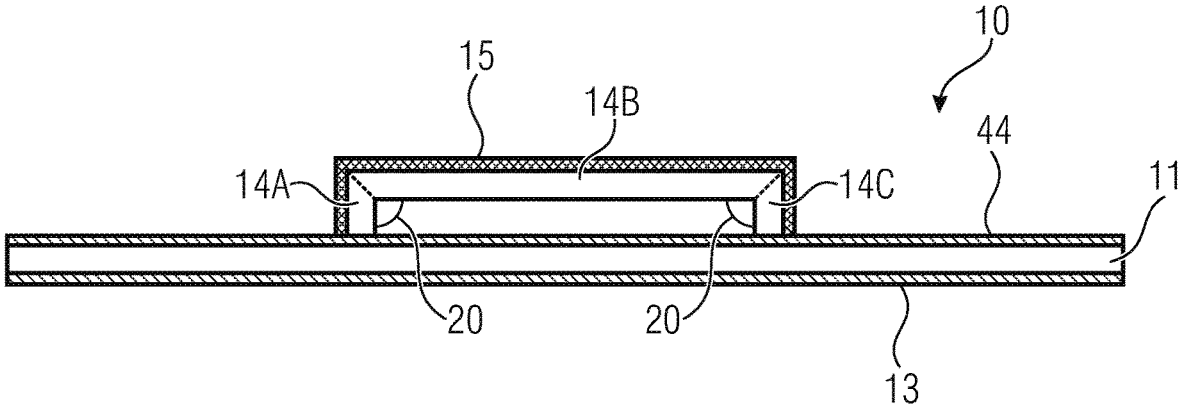

FIGS. 10A and 10B show schematic perspective views of the antenna device 10 in a configuration of FIG. 1, wherein the angles 20 have a value of 90°. The widths of the strip structure 15 and of the three-dimensional shape structure essentially match. In addition, the strip structure 15 covers the three-dimensional shape structure over an entire axial extension between the substrate contact portions 16 and 17.

Figure 10C:
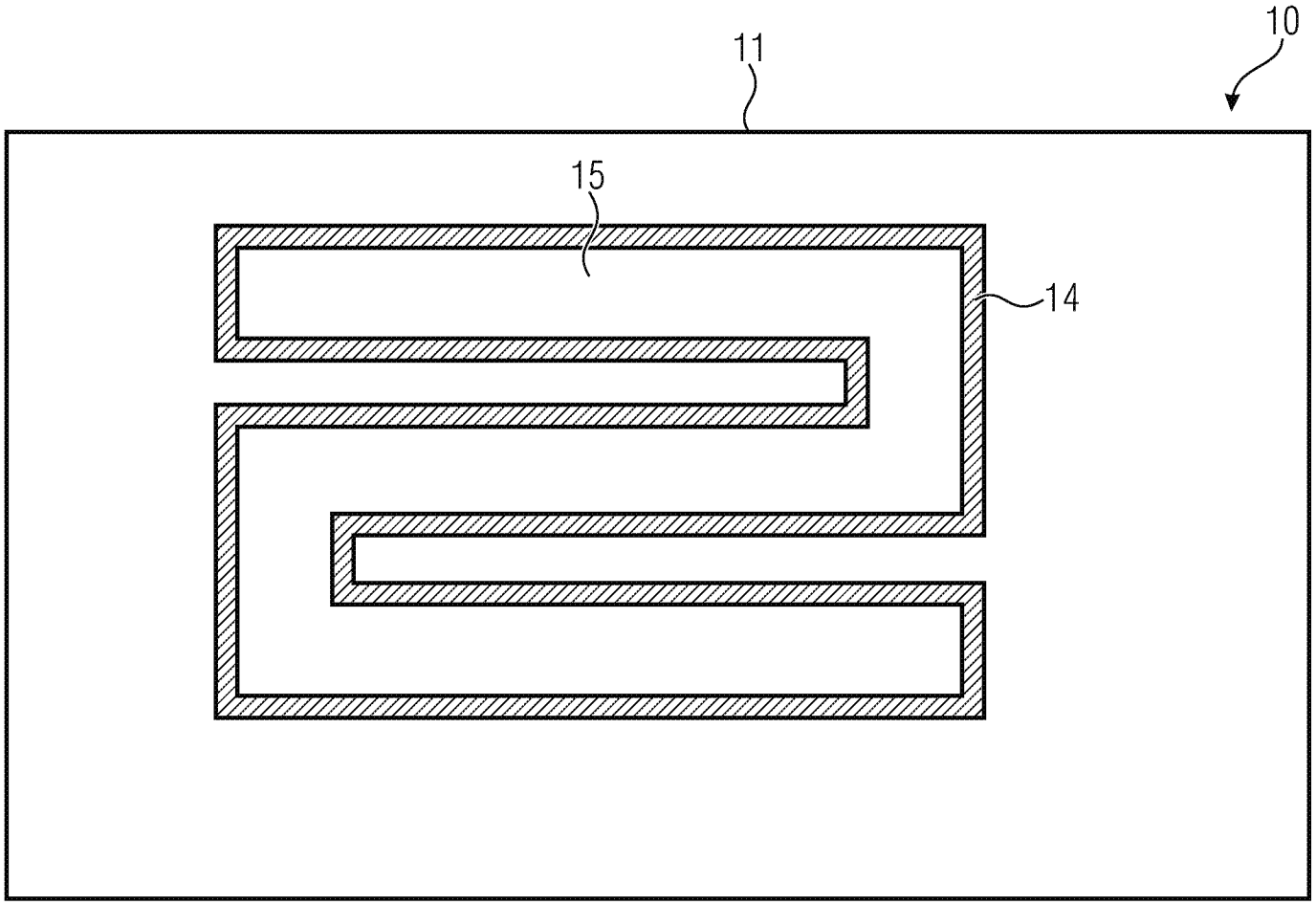
FIG. 10C shows a schematic top view of an inventive antenna device in a configuration wherein the strip structure is formed as a folded strip structure.

FIG. 10C shows a schematic top view of the antenna device 10 in a configuration wherein the strip structure 15 is formed as a folded strip structure, which enables an extended strip length within a small surface area and, therefore, enables producing a low transmit and/or receive frequency with small components. In accordance with embodiments, provision is made for that alternatively or additionally, a supplementary antenna structure is formed in a folded manner. A number of the folds may be arbitrary and enables a strip structure that is formed in a non-straight or, in portions, straight manner. The strip structure 15 may be kinked or curved, i.e., may be shaped to be continuously or discontinuously bent.

Figure 11A:
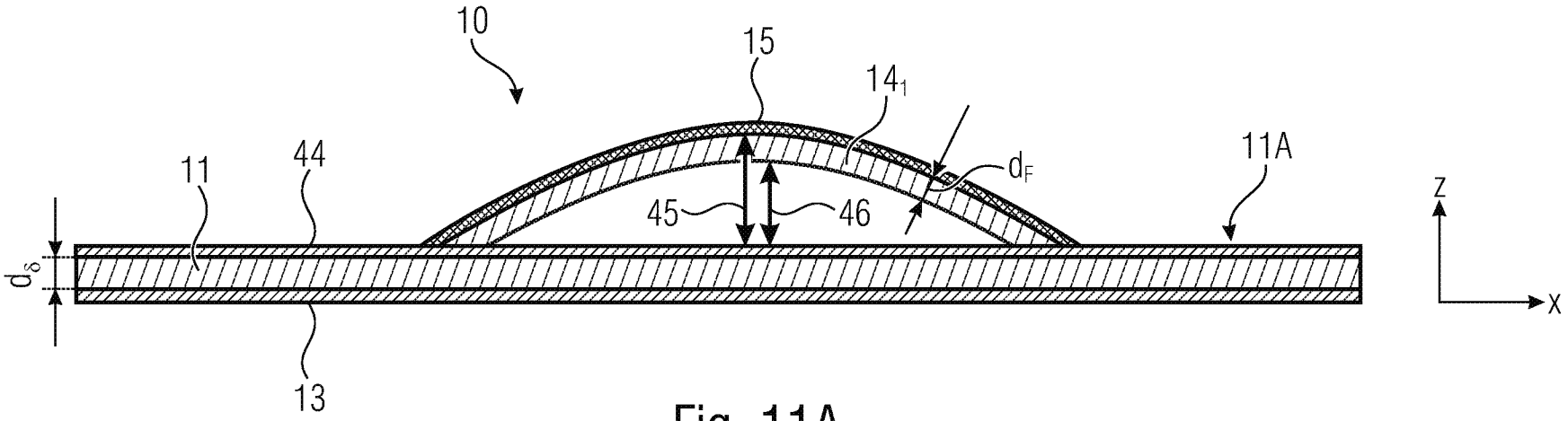
FIGS. 11A-C show schematic sectional side views of an inventive antenna device of FIG. 6A or 6D.
Figure 11B:
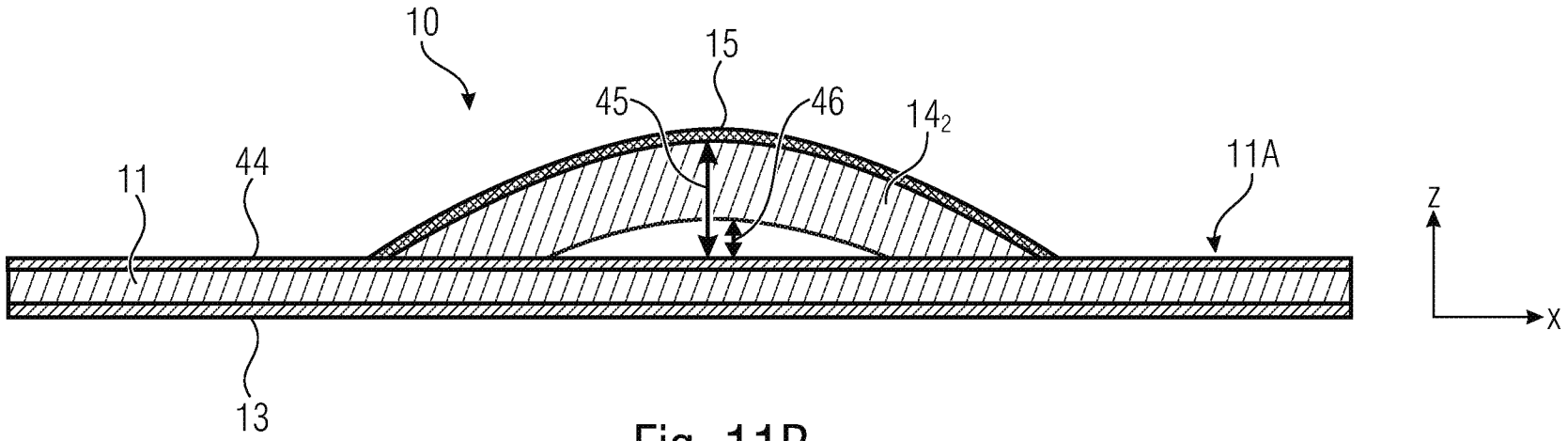
Figure 11C:
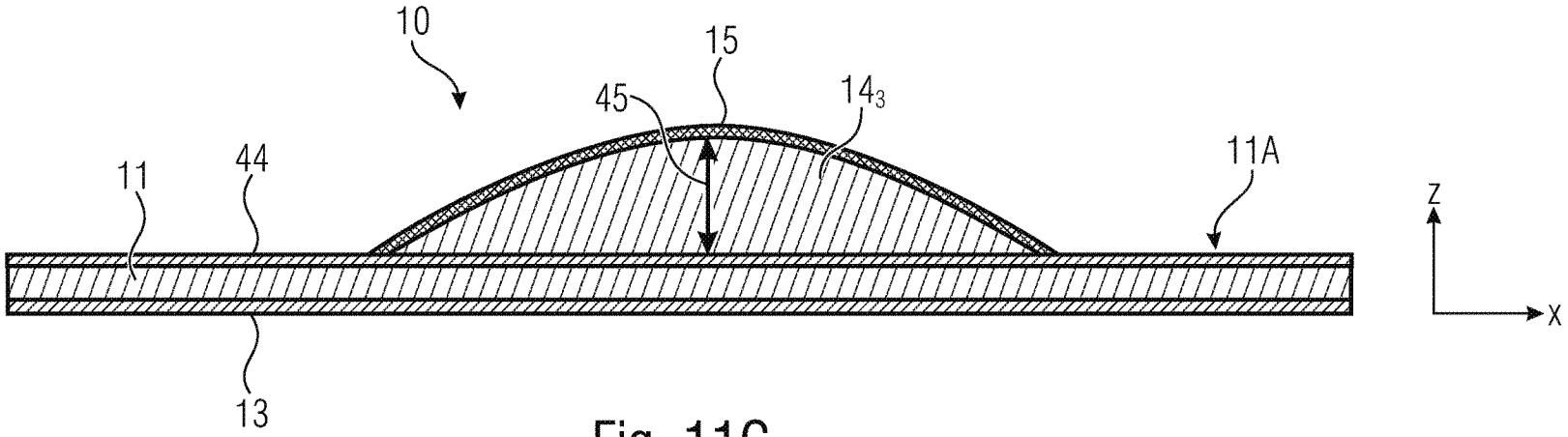

FIGS. 11A, 11B, and 11C show schematic sectional side views of the antenna device 10 in accordance with the configuration of FIG. 6A or FIG. 6D, the explanations being applicable to any other configurations without any restrictions. The three-dimensional shape structure 14 may have different dimensions, e.g., thicknesses, within the x/z plane. With an identical maximum distance 45 between the strip structure 15 and the substrate side 11A, a variable proportion 46 thereof may therefore have a substance or a material arranged therein which is different from that of the three-dimensional shape structure 14, e.g., air. Also, it is feasible that the three-dimensional shape structure 14 spaced apart from the substrate 11 forms a gap between the three-dimensional shape structure 14 and the substrate 11, said gap comprising a dielectric.

In the embodiment depicted, air is provided, e.g., as a dielectric between the three-dimensional shape structure 14 and the substrate 11. In principle, the dielectric arranged within the gap may also be dielectrics other than air.

For example, it would be feasible for the three-dimensional shape structure 14 itself to comprise a dielectric or to be produced from a dielectric; the three-dimensional shape structure 14 may project further into the gap than is shown in FIG. 11A. For example, the three-dimensional shape structure 14 may project up to halfway into the gap. However, it would also be feasible for the three-dimensional shape structure 14 to completely fill the gap.

In the embodiments depicted here, the three-dimensional shape structure 14 has a thickness $d_F$. The three-dimensional shape structure 14 may be made of the same material as the substrate 11, for example. In some feasible embodiments, the three-dimensional shape structure 14 may be configured in one piece with the substrate 11. The thickness $d_F$ may comprise, e.g., a value within a range of several micrometers or several millimeters so as to obtain high stability and low efficiency losses at the same time, e.g., at least 1 μm and at the most 10 mm, at least 10 μm and at the most 1 mm, or at least 30 μm and at the most 100 μm, e.g., 50 μm, other values also being possible.

The thickness of the three-dimensional shape structure 14 may be selected, e.g., as a function of desired mechanical stabilities and/or dielectric properties of the three-dimensional shape structure 14. The higher the mechanical stability, the thicker the three-dimensional shape structure 14 may be formed. The higher the quality of a material of the three-dimensional shape structure 14, the thicker said shape structure 14 may be configured without generating excessive losses of the loop antenna, and vice versa.

Figure 12:
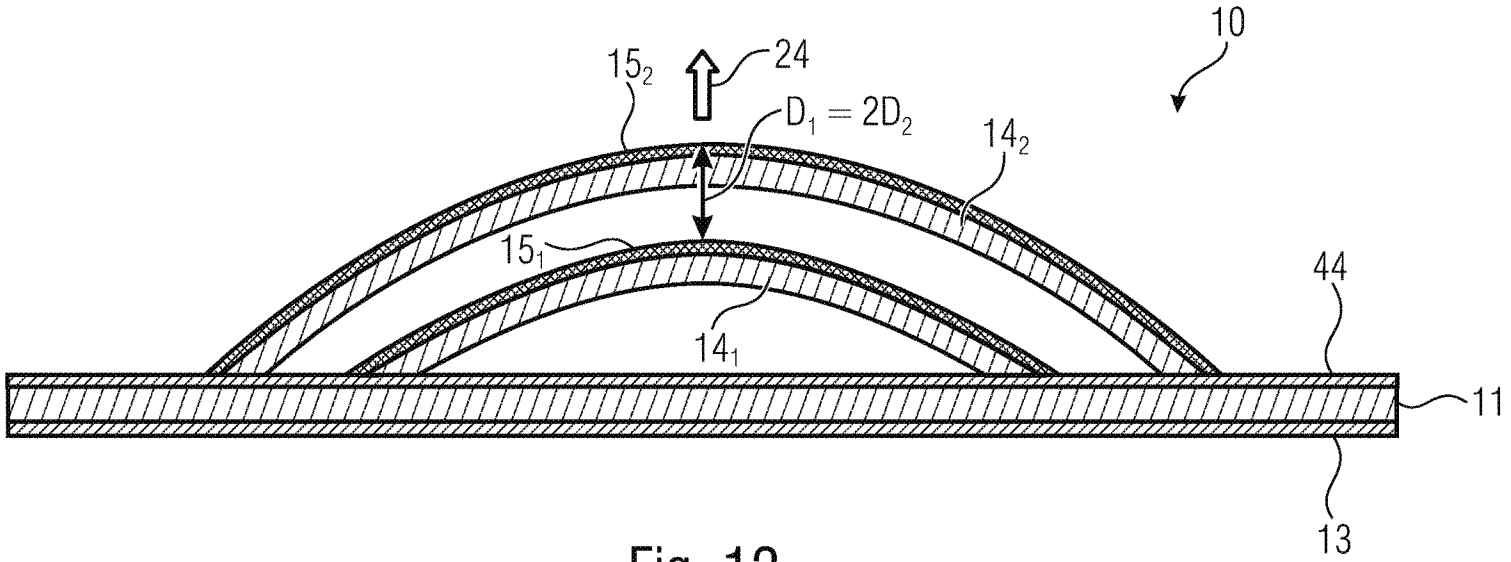
FIG. 12 shows a schematic sectional side view of an inventive antenna device comprising at least a first three-dimensional shape structure and a second three-dimensional shape structure.

FIG. 12 shows a schematic sectional side view of an antenna device 10 in accordance with an embodiment, comprising at least a first three-dimensional shape structure $\mathbf{14}_1$ and a second three-dimensional shape structure $\mathbf{14}_2$. Said second three-dimensional shape structure $\mathbf{14}_2$ also protrudes from the substrate plane. The first three-dimensional shape structure $\mathbf{14}_1$ is arranged between the substrate 11 and the second three-dimensional shape structure $\mathbf{14}_2$, a supplementary strip structure $\mathbf{15}_2$ being arranged on a side of the second three-dimensional shape structure $\mathbf{14}_2$ which faces away from the first three-dimensional shape structure $\mathbf{14}_1$.

The strip structure $\mathbf{15}_1$ and the supplementary strip structure $\mathbf{15}_2$ may be galvanically separated from each other. The supplementary strip structure $\mathbf{15}_2$ may be spaced apart from the strip structure $\mathbf{15}_1$.

In the depicted arc-shaped configuration of the three-dimensional shape structure $\mathbf{14}_1$ and/or $\mathbf{14}_2$, said spacing $D_1$ or $D_2$ may be a spacing between the strip structure $\mathbf{15}_1$ and $15_2$. The spacing $D_1$ may also be a maximum spacing between the strip structures, for example, e.g., also in three-dimensional shape structures $14_1$ and/or $14_2$ which have other shapes than arcs, or with a different shape of the second supplementary strip structure $15_2$ arranged thereon. With three-dimensional shape structures 14 of more complex shapes, the spacing $D_1$ may also be an average spacing between the two strip structures $15_1$ and $15_2$, for example.

Embodiments are not limited to arranging two three-dimensional shape structures but provide, among others, antenna devices comprising at least a third three-dimensional shape structure arranged such that the second three-dimensional shape structure is arranged between the at least one third three-dimensional shape structure and the substrate, the supplementary strip structure being a first supplementary strip structure, and a second supplementary strip structure being arranged at the at least one third three-dimensional shape structure.

Figure 13A:
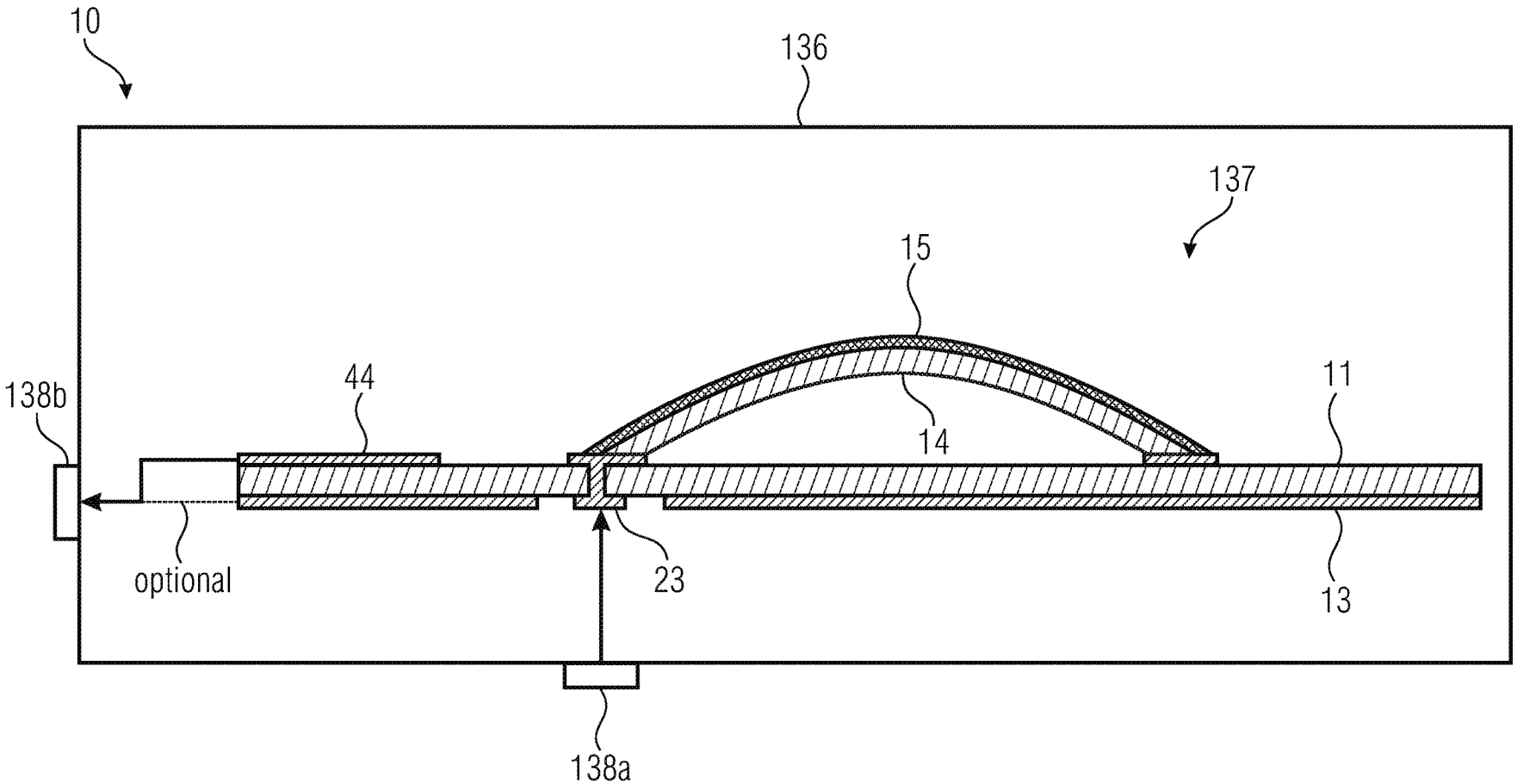
FIG. 13A shows a schematic sectional side view of an antenna device in accordance with an embodiment, which comprises a housing.

FIG. 13A shows a schematic sectional side view of an antenna device 10 in accordance with an embodiment, said antenna device 10 comprising a housing (package) 136. The housing 136 is formed to include, at least in some areas, a dielectric or electrically insulating material so as to enable the radio signal to exit from the housing 136. For example, the housing 136 may include a plastic material or a glass material. Plastic material may be arranged during dicing and encapsulation of the antenna device 10 from a wafer. The housing 136 may have the antenna device 10 arranged therein. Alternatively or additionally, a different antenna device in accordance with embodiments described herein, at least one antenna array and/or at least one electric device 10 in accordance with embodiments described herein may be arranged inside the housing 136. An internal volume 137 of the housing 136 may be at least partly filled with a gas such as air, for example, or with a material having a small dielectric constant or with a material resulting in low power loss.

An antenna array in accordance with embodiments may comprise at least a first antenna device and a second antenna device.

The housing 136 includes a terminal 138*a*, which may be connected to the antenna feed line 23. The terminal 138*a* is configured to be connected to a signal output of a high-frequency chip. This means that a high-frequency signal may be received via the terminal 138*a*, for example. The housing 136 may comprise a further terminal 138*b*, which may be connected to a possibly arranged front-side metallization 44 and/or to the rear-side metallization 13. For example, the terminal 138*b* is connected to an electric line which is configured as a return line and may be implemented by the rear-side metallization 13.

Figure 13B:
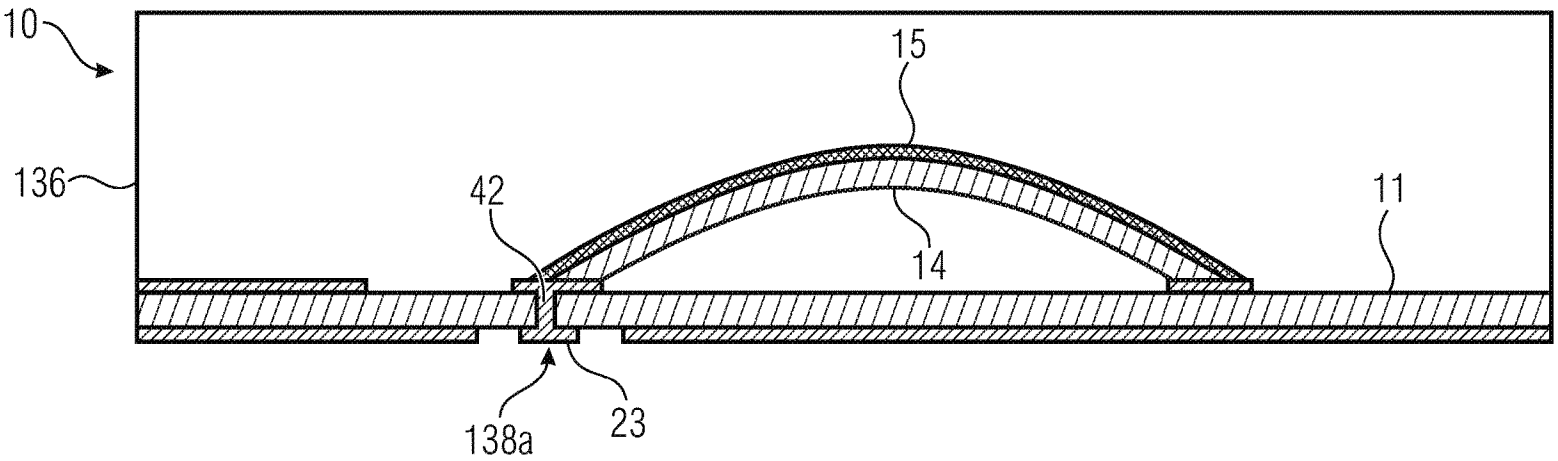
FIG. 13B shows a schematic sectional side view of an antenna device in accordance with a further embodiment, which comprises a housing and wherein the rear-side metallization is connected to a wall of the housing or forms said wall.

FIG. 13B shows a schematic sectional side view of an antenna device 10 in accordance with a further embodiment, which comprises a housing 136 and wherein the rear-side metallization 13 is connected to a wall of the housing 136 or forms said wall, so as to enable contacting of the rear-side metallization 13 with other components in a simple manner. The terminal 138 may be connected to an electrically conductive structure 42, e.g., a via. The terminal 138*a* may serve to provide a vertical connection to the antenna device 10, e.g., at the antenna feed line 23, so as to excite the antenna device 10. Thus, the terminal 138*a* may provide a contact with the surroundings of the antenna device 10.

Figure 13C:
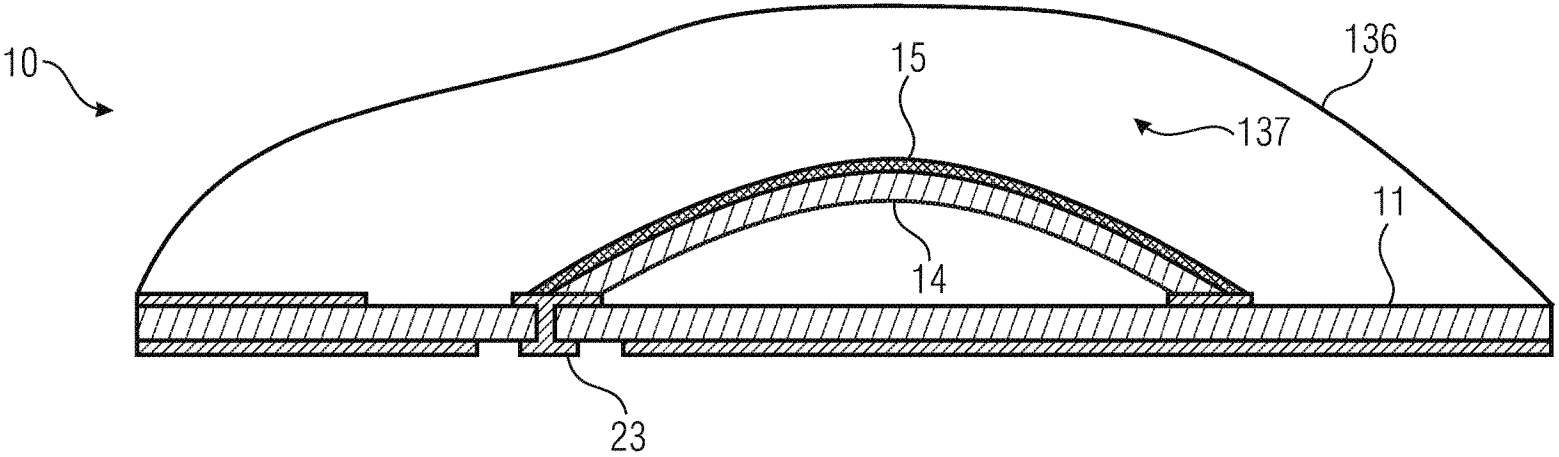
FIG. 13C shows a schematic sectional side view of an antenna device in accordance with a further embodiment, wherein the housing is configured as a lens as compared to FIG. 13B.

FIG. 13C shows a schematic sectional side view of an antenna device 10 in accordance with a further embodiment, wherein the housing 136 is configured, in contrast to FIG. 13B, as a lens which is configured to influence radiation characteristics of the radio signal. For example, the lens may be configured to collimate the radio signal. For example, the internal space 137 of the housing 136 may be at least partly filled with a dielectric material, and an external shape of the housing 136 may be concave or convex so as to obtain a scattering or collimating function of the lens. The housing 136 may be arranged with any antenna devices in accordance with embodiments described herein.

Figure 14:
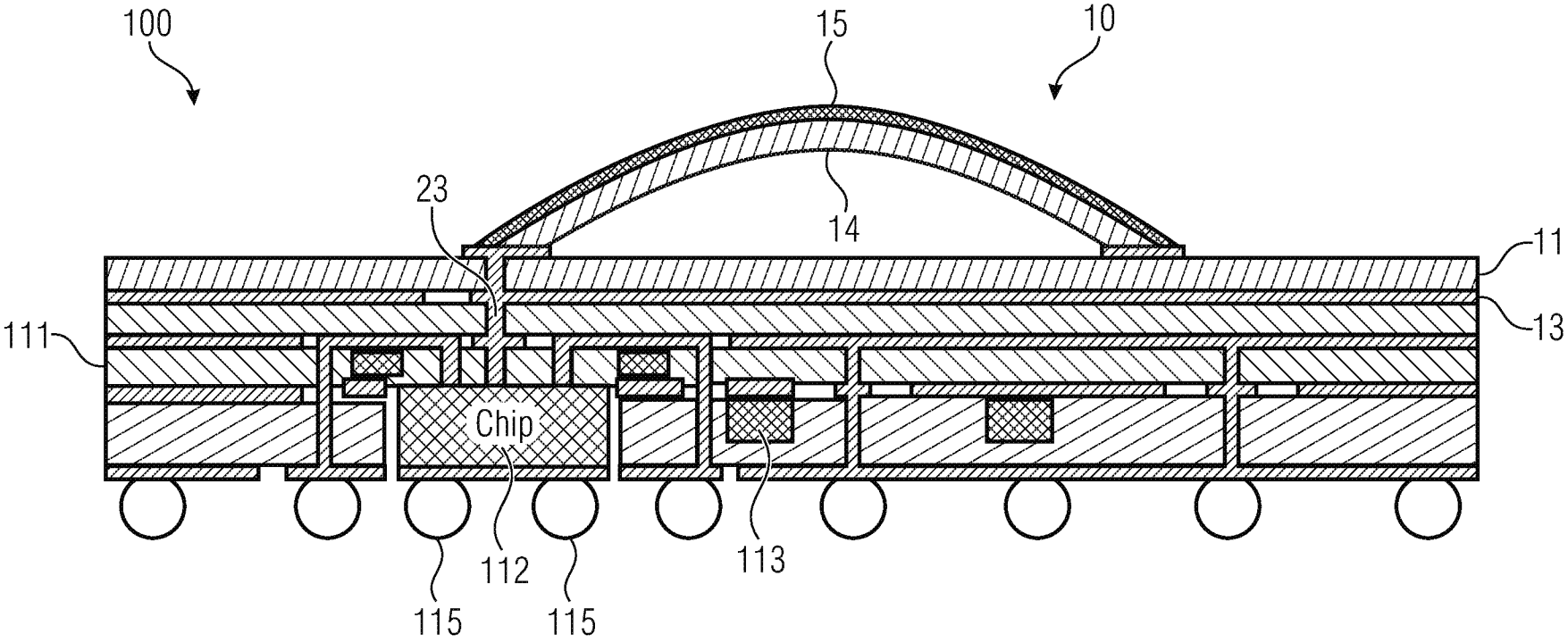
FIG. 14 shows a schematic lateral sectional view of an electric device comprising an antenna device in accordance with an embodiment.
Figure 15:
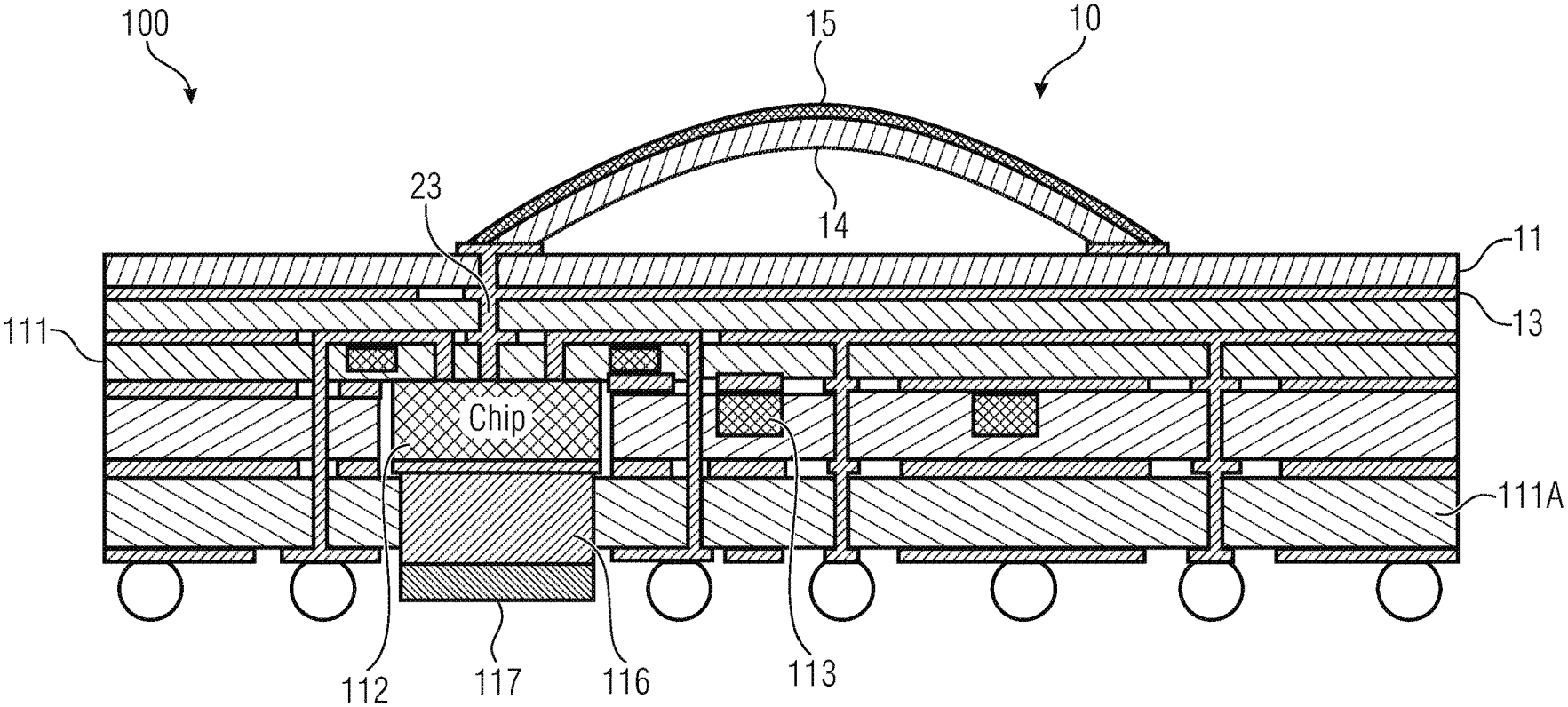
FIG. 15 shows a further schematic lateral sectional view of an electric device comprising an antenna device in accordance with an embodiment.
Figure 16:
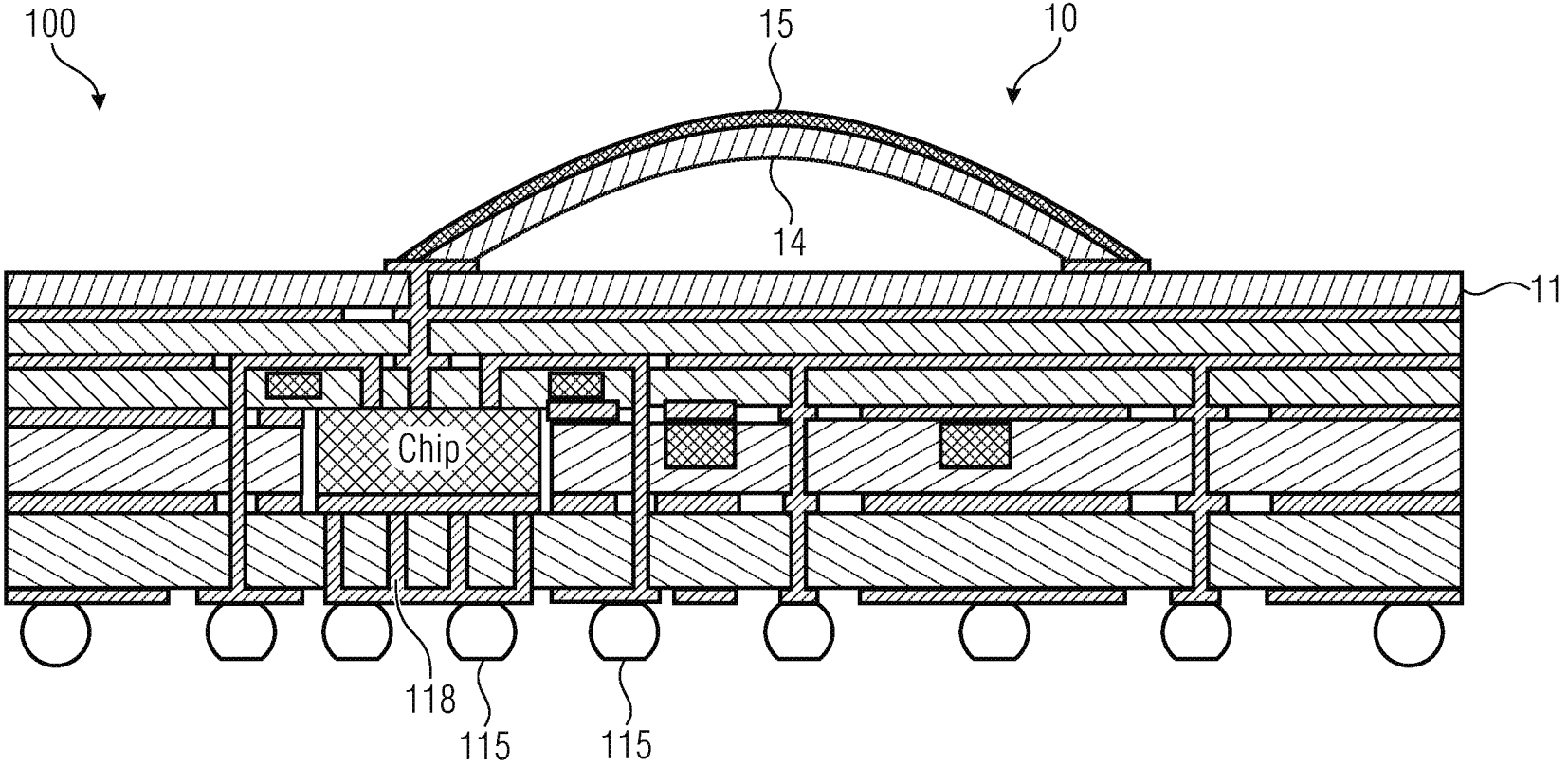
FIG. 16 shows a further schematic lateral sectional view of an electric device comprising an antenna device in accordance with an embodiment.

FIGS. 14 to 16 show an electric device 100 having an antenna device 10 described herein. The electric device 100 comprises a substrate 111 comprising a multi-layered circuit structure, which may be a circuit-board substrate, for example.

The multi-layered circuit structure may comprise at least one embedded, or integrated, circuit component 113. Alternatively or additionally, the multi-layered circuit structure may comprise at least one high-frequency chip 112 which may be embedded, or integrated, in the multi-layered circuit structure.

The antenna device 10 is arranged at the substrate 111 and coupled to the multi-layered circuit structure. For example, the antenna device 10 may be arranged with its rear-side metallization 13 directly at the substrate 111 and in this manner be mechanically coupled to the substrate 111 and be electrically coupled to the multi-layered circuit structure. Thus, the antenna device 10 may be simply arranged on an upper layer of conventional packages or system boards and may be integrated into a conventional high-frequency circuit.

In this context, the antenna device 10 may be electrically connected to the high-frequency chip 112. This may be accomplished, for example, by means of a via 42 which electrically couples the high-frequency chip 112 to the antenna feed line 23 and/or directly to the strip structure 15. The antenna device 10 is configured to emit a high-frequency signal of the high-frequency chip 112 and/or to receive a high-frequency signal and to provide same to the high-frequency chip 112 for further processing.

Integration of the antenna device 10 in the electric device 100 is particularly easy because the substrate is configured to be planar, even though the antenna structure is three-dimensional at least in the area of the strip structure.

For connecting or contacting the electric device 100 on a further substrate (which is not explicitly depicted here), contacting elements 115, e.g., solder balls, may be provided in order to enable a non-detachable connection while using the solder, e.g., by soldering and/or so-called reflow processes, as depicted in FIG. 14.

In order to thermally decouple the high-frequency chip 112, the solder balls 115 may be arranged at the high-frequency chip 112. The solder balls 115 exhibit a high thermal conductance value in order to dissipate heat which is generated from the high-frequency chip 112. Alternatively or additionally, heat dissipation or heat extraction may be obtained by using a heat sink 117, as depicted in FIG. 15. The heat sink 117 may be connected to the high-frequency chip 112 by means of a conductive adhesive.

A different possibility of achieving thermal decoupling which may be employed alternatively or additionally is depicted in FIG. 15. As compared to FIG. 14, a heat conduction element 116 having a high heat conductance value, e.g., a metal block, may be provided. Said metal block is not restricted to be deposed only directly underneath the chip but may be expanded to the entire width of the substrate. As compared to FIG. 14, the substrate 111 may comprise, e.g., an additional substrate layer 111A which may have the heat conductance element 116 arranged therein.

Optionally, a heat sink 117 may be additionally provided. The heat sink 117 may be arranged on the bottom of the heat conductance element 116, so that the heat conductance element 116 is arranged between the high-frequency chip 112 and the heat sink 117. The heat sink 117 may be arranged on a further substrate (which is not explicitly shown here). The heat conductance element may alternatively be fully or partly implemented as an adhesive material, for which purpose different materials may be used, e.g., a hardening adhesive and/or thermally conductive pastes.

A further alternative to thermal decoupling is depicted in FIG. 16. As compared to FIG. 15, at least one thermal via 118 may be provided in addition or alternatively to the heat conductance element 116. Said via 118 may essentially serve the same purposes as the heat conductance element 116. The via 118 may be coupled by means of thermal balls 115 and/or by means of a heat sink (not depicted here), in a manner comparable to that of the heat sink 117 depicted in FIG. 15.

In accordance with further embodiments, which are not explicitly depicted here, at least two of the antenna devices 10 described herein may be combined to form an antenna array.

Even though in the embodiments previously described, the width of the three-dimensional shape structure 14 is constant, the width may also be variable across the length L of the strip structure. The strip structure 15 may also be folded and not only be a straight line, as was described so far. As a result, a longer length of the strip structure may be arranged within the length A (see FIG. 2A) than in the case where the strip structure is designed to be a straight line. This enables using the strip antenna also for low-frequency applications, e.g., within the megahertz frequency range.

The three-dimensional shape structure 14 may have a non-constant width. For example, the three-dimensional shape structure 14 may comprise a first portion which is arranged to be located opposite the substrate 11 in a projection perpendicular to the substrate plane 12.

This first portion of the three-dimensional shape structure 14 may have a width equal to or larger than a width of the strip structure 15.

In addition, the three-dimensional shape structure 14 may comprise at least a second portion which has a smaller or larger width as compared to the first portion.

The inventive antenna device 10 may be advantageously operated within frequency ranges of from 1 GHz to 1 THz.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An antenna device comprising a substrate extending within a substrate plane, the substrate comprising a first side and an oppositely arranged second side, and a three-dimensional shape structure which is arranged on the first side and protrudes from the substrate plane, and a strip structure arranged at the three-dimensional shape structure, and a rear-side metallization which is arranged on the second side of the substrate and is electrically coupled to the strip structure so that the strip structure and the rear-side metallization form a loop antenna.

2. The antenna device as claimed in claim 1, wherein the strip structure is galvanically coupled to the rear-side metallization by means of a via extending from the first side of the substrate to the second side of the substrate.

3. The antenna device as claimed in claim 1, wherein the strip structure is galvanically separated from the rear-side metallization and is capacitively coupled to the rear-side metallization.

4. The antenna device as claimed in claim 3, comprising a front-side metallization which is arranged on the first side and forms a coplanar arrangement with the supply line, wherein an antenna end which faces away from the supply line is electrically connected to the front-side metallization.

5. The antenna device as claimed in claim 1, comprising a front-side metallization which is arranged on the first side and is electrically connected to the rear-side metallization by means of a via.

6. The antenna device as claimed in claim 1, comprising a first antenna terminal galvanically connected to the strip structure, and a second antenna terminal galvanically connected to the rear-side metallization, the loop antenna being configured to be operated by connecting a signal source or a signal sink to the first and second antenna terminals.

7. The antenna device as claimed in claim 1, wherein the strip structure comprises an axial extension between a first antenna end and a second antenna end, an antenna frequency of the strip structure being at least influenced by the axial extension.

8. The antenna device as claimed in claim 1, wherein the first substrate side has at least one metallization face arranged thereon, adjacently to the supply line, said at least one metallization face being operative to achieve impedance matching of the strip antenna.

9. The antenna device as claimed in claim 1, wherein the three-dimensional shape structure comprises a first substrate contact portion and a second substrate contact portion and extends between the first substrate contact portion and the second substrate contact portion at a distance from the substrate, and wherein the strip structure is arranged between the first substrate contact portion and the second substrate contact portion.

10. The antenna device as claimed in claim 1, wherein the strip structure extends within a plane parallel to the substrate plane or within a second plane that is not parallel in relation to the substrate plane.

11. The antenna device as claimed in claim 1, wherein the three-dimensional shape structure comprises a first side which is arranged opposite the substrate and faces same, and wherein the three-dimensional shape structure comprises a second side which is arranged opposite the first side and faces away from the substrate, the strip structure being arranged on the second side of the three-dimensional shape structure.

12. The antenna device as claimed in claim 1, wherein the strip structure is arranged in a direction perpendicular to the substrate plane.

13. The antenna device as claimed in claim 1, wherein the three-dimensional shape structure is spaced apart from the substrate in some areas, and wherein a gap between the three-dimensional shape structure and the substrate comprises a dielectric.

14. The antenna device as claimed in claim 1, wherein the three-dimensional shape structure comprises a dielectric, and/or wherein the three-dimensional shape structure is produced from the same material as the substrate, and/or wherein that the three-dimensional shape structure and the substrate are formed in one piece.

15. The antenna device as claimed in claim 1, wherein the three-dimensional shape structure exhibits, in a projection perpendicular to the substrate plane, a width perpendicular to an axial extension of the strip structure, said width being larger than or equal to a width of the strip structure.

16. The antenna device as claimed in claim 1, wherein the three-dimensional shape structure is a first three-dimensional shape structure, the antenna device comprising a second three-dimensional shape structure which protrudes from the substrate plane, the first three-dimensional shape structure being arranged between the substrate and the second three-dimensional shape structure, a supplementary antenna structure being arranged on a side of the second three-dimensional shape structure which faces away from the first three-dimensional shape structure.

17. The antenna device as claimed in claim 16, wherein the strip structure and the supplementary antenna structure are galvanically separated from each other.

18. The antenna device as claimed in claim 16, wherein the supplementary antenna structure is spaced apart from the strip structure.

19. The antenna device as claimed in claim 16, comprising at least one third three-dimensional shape structure arranged such that the second three-dimensional shape structure is arranged between the at least one third three-dimensional shape structure and the substrate, the supplementary antenna structure being a first supplementary strip structure, and a second supplementary strip structure being arranged at the at least one third three-dimensional shape structure.

20. The antenna device as claimed in claim 1, further comprising a housing having the antenna device arranged therein, the housing comprising a terminal for connecting the antenna device to a high-frequency chip.

21. The antenna device as claimed in claim 20, wherein the housing forms a lens configured to collimate or scatter a radio signal produced by the antenna device or received by the antenna device.

22. The antenna device as claimed in claim 1, wherein the strip structure or a supplementary antenna structure is formed as a folded strip structure.

23. An antenna array comprising first and second antenna devices as claimed in claim 1.

24. An electric device comprising a multi-layered circuit structure which comprises at least one high-frequency chip, and comprising an antenna arrangement which comprises:

an antenna device comprising:

a substrate extending within a substrate plane, the substrate comprising a first side and an oppositely arranged second side, and a three-dimensional shape structure which is arranged on the first side and protrudes from the substrate plane, and a strip structure arranged at the three-dimensional shape structure, and a rear-side metallization which is arranged on the second side of the substrate and is electrically coupled to the strip structure so that the strip structure and the rear-side metallization form a loop antenna, and/or an antenna array as claimed in claim 23, wherein the antenna arrangement is arranged at the multi-layered circuit structure and is electrically connected to the high-frequency chip, and wherein the antenna arrangement is configured to emit a high-frequency signal of the high-frequency chip and/or to receive a high-frequency signal and to provide same to the high-frequency chip.

* * * * *